US011684936B2

(12) United States Patent
Burgess et al.

(10) Patent No.: US 11,684,936 B2
(45) **Date of Patent: *Jun. 27, 2023**

(54) HIGH VELOCITY SPRAY TORCH FOR SPRAYING INTERNAL SURFACES

(71) Applicant: Alan W. Burgess, North Vancouver (CA)

(72) Inventors: Alan W. Burgess, North Vancouver (CA); Dejan Maksimovic, Burnaby (CA)

(73) Assignee: Alan W. Burgess, North Vancouver (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/234,452

(22) Filed: Apr. 19, 2021

(65) Prior Publication Data

US 2021/0237106 A1 Aug. 5, 2021

Related U.S. Application Data

(63) Continuation of application No. 16/329,103, filed as application No. PCT/CA2017/051044 on Sep. 6, 2017, now Pat. No. 11,000,868.

(Continued)

(51) Int. Cl.
*B05B 7/20* (2006.01)
*B05B 5/12* (2006.01)

(Continued)

(52) U.S. Cl.
CPC ..... *B05B 7/205* (2013.01); *B05B 1/00* (2013.01); *B05B 5/12* (2013.01); *B05D 7/22* (2013.01); *C23C 4/06* (2013.01); *C23C 4/129* (2016.01)

(58) Field of Classification Search
USPC ..... 118/302, 306, 317; 239/79, 424; 427/446, 449, 230, 236
See application file for complete search history.

(56) References Cited

U.S. PATENT DOCUMENTS 4,370,538 A 1/1983 Browning
4,416,421 A 11/1983 Browning
(Continued)

FOREIGN PATENT DOCUMENTS

CA 2445169 10/2002
CA 2481152 3/2005
(Continued)

OTHER PUBLICATIONS

"Method of manufacturing TiO2 nanoparticles by plasma thermal spraying metal organic liquid material", Feng, Lajun, et al., Journal of Yunnan University, 2005, 27 (S1). English abstract on p. 4.
(Continued)

*Primary Examiner* — Yewebdar T Tadesse
(74) *Attorney, Agent, or Firm* — Oyen Wiggs Green & Mutala LLP

(57) ABSTRACT

A thermal spray apparatus to apply coatings to external and internal surfaces in restricted areas is provided. The apparatus includes: a combustion chamber having a primary passage for combustion of fuel received through a fuel input line with oxygen or air received through an oxidizing gas input line; a divergence section located downstream of the combustion chamber; an elbow housing located downstream of the divergence section. A nozzle housing retaining a nozzle having an injection zone and a nozzle throat; a convergence section retained between the elbow housing and the nozzle housing; a feedstock injector for the injection of feedstock material into the injection zone of said nozzle; and a plurality of passageways extending through the combustion chamber, the divergence section, the elbow housing,
(Continued)

and the convergence section for passing a coolant therethrough.

13 Claims, 22 Drawing Sheets

Related U.S. Application Data

(60) Provisional application No. 62/384,272, filed on Sep. 7, 2016.

(51) Int. Cl.

| | |
|---|---|
| ***B05B 1/00*** | (2006.01) |
| ***C23C 4/06*** | (2016.01) |
| ***C23C 4/129*** | (2016.01) |
| ***B05D 7/22*** | (2006.01) |

(56) References Cited

U.S. PATENT DOCUMENTS

| | | | | |
|---|---|---|---|---|
| 4,836,447 | A | 6/1989 | Browning | |
| 5,073,193 | A | 12/1991 | Chaklader et al. | |
| 5,120,582 | A | 6/1992 | Browning | |
| 5,271,965 | A | 12/1993 | Browning | |
| 5,285,967 | A * | 2/1994 | Weidman | C23C 4/129 239/85 |
| 5,330,798 | A | 7/1994 | Browning | |
| 5,334,235 | A | 8/1994 | Dorfman et al. | |
| 5,770,126 | A | 6/1998 | Singh et al. | |
| 5,788,738 | A | 8/1998 | Pirzada et al. | |
| 5,851,507 | A | 12/1998 | Pirzada et al. | |
| 6,202,939 | B1 | 3/2001 | Delcea | |
| 6,245,390 | B1 | 6/2001 | Baranovski et al. | |
| 6,392,189 | B1 | 5/2002 | Delcea | |
| RE37,853 | E | 9/2002 | Detering et al. | |
| 6,472,632 | B1 | 10/2002 | Peterson et al. | |
| 6,569,397 | B1 | 5/2003 | Yadav et al. | |
| 6,580,051 | B2 | 6/2003 | Peterson et al. | |
| 6,689,192 | B1 | 2/2004 | Phillips et al. | |
| 6,886,757 | B2 | 5/2005 | Byrnes et al. | |
| 7,108,893 | B2 | 9/2006 | Van Steenkiste et al. | |
| 7,125,537 | B2 | 10/2006 | Liao et al. | |
| 7,608,797 | B2 | 10/2009 | Belashchenko et al. | |
| 8,455,056 | B1 | 6/2013 | Browning | |
| 11,000,868 | B2 * | 5/2021 | Burgess | B05B 7/205 |
| 2002/0155059 | A1 | 10/2002 | Boulos et al. | |
| 2003/0116228 | A1 | 6/2003 | Pozarnsky | |
| 2003/0143153 | A1 | 7/2003 | Boulos et al. | |
| 2004/0226508 | A1 | 11/2004 | Ma et al. | |
| 2005/0118094 | A1 | 6/2005 | Zhang | |
| 2005/0186132 | A1 | 8/2005 | Liao et al. | |
| 2005/0199739 | A1 | 9/2005 | Kuroda et al. | |
| 2005/0255419 | A1 | 11/2005 | Belashchenko et al. | |
| 2010/0136229 | A1 | 6/2010 | Kawakita et al. | |
| 2011/0229649 | A1 | 9/2011 | Baranovski et al. | |
| 2012/0082797 | A1 | 4/2012 | Allcock et al. | |
| 2013/0160606 | A1 | 6/2013 | Halder et al. | |
| 2014/0370324 | A1 | 12/2014 | Watanabe et al. | |
| 2019/0224701 | A1 | 7/2019 | Burgess | |

FOREIGN PATENT DOCUMENTS

| | | | |
|---|---|---|---|
| CN | 2629878 | Y | 8/2004 |
| CN | 102428203 | A | 4/2012 |
| DE | 4111231 | A1 | 10/1992 |
| DE | 102005063145 | A1 | 7/2007 |
| EP | 0049915 | B1 | 6/1985 |
| EP | 1415741 | A2 | 5/2004 |
| EP | 1514845 | A1 | 3/2005 |
| WO | 9323585 | A1 | 11/1993 |
| WO | 02/061163 | A2 | 8/2002 |
| WO | 02/086179 | A2 | 10/2002 |
| WO | 03/097521 | A1 | 11/2003 |
| WO | 2004/007357 | A1 | 1/2004 |
| WO | 2004/052778 | A2 | 6/2004 |
| WO | 2004/056461 | A2 | 7/2004 |
| WO | 2007109906 | A1 | 10/2004 |
| WO | 2004/103900 | A1 | 12/2004 |
| WO | 2009/155702 | A1 | 12/2009 |

OTHER PUBLICATIONS

International Search Report completed on Jul. 9, 2007 in respect of Patent Cooperation Treaty Application No. PCT/CA2007/00514 (Publ. No. WO 2007/109906).

Supplementary European Search Report (EPO Form 1503) dated Mar. 27, 2020 issued on EP Appl. No EP 17 84 7845.

* cited by examiner

HIGH VELOCITY SPRAY TORCH FOR SPRAYING INTERNAL SURFACES

CROSS REFERENCE TO RELATED APPLICATIONS

The present application is a continuation-in-part of U.S. patent application Ser. No. 16/329,103 entitled "High Velocity Spray Torch for Spraying Internal Surfaces" filed Feb. 27, 2019 which is pending and claims the benefits, under 35 U.S.C. § 119(e), of U.S. Provisional Application Ser. No. 62/384,272 filed Sep. 7, 2016 entitled "High Velocity Spray Torch with Liquid or Gas Coolant and Accelerant", all of which are incorporated herein by this reference.

TECHNICAL FIELD

The present invention relates to thermal spray devices and processes for coating deposition, and more particularly to High Velocity Oxygen Fuel (HVOF) or High Velocity Air Fuel (HVAF) spray processes used to apply wear and corrosion resistant coatings for commercial applications.

BACKGROUND

Thermal spray apparatus and methods are used to apply coatings of metal or ceramics to different substrates. The HVOF process was first introduced as a further development of the flame spray process. It did this by increasing the combustion pressure to 3-5 Bar, and now most third generation HVOF torches operate in the 8-12 Bar range with some exceeding 20 Bar. In the HVOF process, the fuel and oxygen are combusted in a chamber. Combustion products are expanded in an exhaust nozzle reaching sonic and supersonic velocities.

In the first commercial HVOF system, Jet Kote™, developed by James Browning, particle velocities were increased from approximately 50 m/s for the flame spray process to about 450 m/s. The increased particle velocities resulted in improved coating properties in terms of density, cohesion and bond strength resulting in superior wear and corrosion properties. In the past thirty years many variations of this process have been introduced. Modern third generation HVOF guns with de Laval, convergent-divergent nozzles result in mean particle velocities on the order of 1000 m/s. High velocity air fuel (HVAF) spray processes have become more popular due to the potentially better economics using lower cost air as opposed to oxygen. HVAF torches operate at lower temperatures due to the energy required to heat the nitrogen in the air that does not participate in the combustion process in any significant way compared to HVOF torches at the same fuel flow rates.

Key high velocity torch and process design features are largely dictated by the type of fuel used. Fuels used can be gaseous such as propane, methane, propylene, MAPP-gas, natural gas and hydrogen, or liquid hydrocarbons such as kerosene, ethanol and diesel. Other considerations include: a) combustion chamber design; b) torch cooling media; c) nozzle design; d) powder injection; and e) secondary air. The choice of the combustible fuel determines the following flame parameters: a) flame temperature; b) stoichiometric oxygen requirement; and c) reaction products. These combustion characteristics along with a fixed high velocity torch internal geometry determine particle acceleration and velocity and particle temperature.

With current systems the nozzle exit of the torch must be about 6 inches from the surface to be coated in order for the particles to reach sufficient velocity and temperature when they reach the target surface in order to provide a suitable coating. This makes the coating of surfaces in restricted areas, for example the inside surfaces of small pipes, difficult or impossible. There is therefore a need for a thermal spray torch in which the particle temperature and velocity is reached in a shorter distance from the nozzle to permit coating in smaller, restricted areas.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One aspect of the present invention relates to a method and apparatus to provide a high velocity flame torch suitable to apply coatings to external and internal surfaces in restricted areas. By configuring the nozzle dimensions and combustion gas passages whereby in operation the injection pressure of the feed stock material upstream of the nozzle throat approximates the combustion pressure upstream of the nozzle throat, a higher particle velocity and temperature within a shorter distance from the nozzle exit is permitted. This may be achieved by maintaining a low ratio of nozzle length to nozzle throat diameter, namely 5 or less, and using a narrow throat diameter to maintain sufficient pressure in the injection zone to provide good heat transfer between hot gas and feed stock material. It may also be achieved by providing a combustion gas passage for the flow of the combustion gas between the combustion chamber and the nozzle whose cross-sectional area is not significantly constricted between the combustion chamber and the nozzle exit except for the nozzle throat. This may also be achieved by configuring the combustion gas passage whereby the sum of the cross-sectional areas of the hot gas passages at each location downstream from the combustion chamber to the nozzle throat is greater than the cross-sectional area of the nozzle throat, whereby the injection pressure approximates the combustion pressure. However, as the components are reduced in size the combustion pressure will be higher than the injection pressure to maintain adequate gas flow in reduced size of hot gas passages.

Another aspect of the invention provides a high velocity oxygen fuel (HVOF) or high velocity air fuel (HVAF) thermal spray apparatus. The apparatus can be used to apply coatings to external and internal surfaces of a target. The apparatus comprises a combustion chamber having a primary passage for combustion of fuel received through a fuel input line with oxygen or air received through an oxidizing gas input line. A divergence section is located downstream of the combustion chamber. The divergence section has two or more channels that diverge relative to a longitudinal axis of the primary passage of the combustion chamber. An elbow housing is located downstream of the divergence section. A nozzle housing is located downstream of the elbow housing. The nozzle housing retains a nozzle having an injection zone and a nozzle throat. A convergence section is retained between the elbow housing and the nozzle housing. The convergence section has two or more channels that converge toward the injection zone of the nozzle. The apparatus also comprises a feedstock injector for the injection of feedstock material (for forming said coatings) into the injection zone of said nozzle. The apparatus also comprises a plurality of passageways extending through said combustion chamber, said divergence section, said elbow housing, and said convergence section for passing a coolant therethrough.

In some embodiments, a fuel combusts with an oxidizer to produce a high velocity jet and further accelerating this jet with an optional accelerating gas. There are generally at least two types of accelerating gas that can be used. These include a gas such as nitrogen, carbon dioxide or argon or alternatively a combustible fuel to increase temperature and pressure. Using a high density gas such as carbon dioxide or argon increases the drag coefficient and accelerates the feedstock material faster. Increasing the pressure of the gas will also increase the density of the gas through the principles of the ideal gas law.

$$\rho = P/RT,$$

where ρ=density, P=pressure, R=Gas constant, T=temperature

A combination of carbon dioxide and a combustion gas can also be used. It is also possible to use supercritical carbon dioxide as a supply of carbon dioxide to increase the drag coefficient.

Closer spray distance can also be obtained through a combination of the following characteristics:

a. Small physical size;
b. Use of small diameter nozzles;
c. Increased injection pressure;
d. Use of smaller feedstock particles;
e. Use of accelerating gas; and
f. Increased power relative to torch size.

The injection of the optional accelerating gas may be upstream of the nozzle. The accelerating gas can be added to the oxidizing gas input, as is the case with HVAF where nitrogen is a dilatant of oxygen in the form of air and in effect acts as an accelerating gas. Having an accelerating gas added to the oxidant gas stream, in an amount less than the 78%, which is the approximate volume fraction of nitrogen in air, can be used. For example nitrogen could be added at 20% that would increase the total gas flow over a stoichiometric gas mixture, but not decrease the overall temperature as much as would be the case with air at 78% nitrogen.

The high velocity torch may be water cooled or Air and/or $CO_2$ cooled. However, the use of Air and/or $CO_2$ may restrict the power level the torch can reach and therefore water cooling is preferred.

The convergence and nozzle design can result in higher injection pressures. The nozzle is characterized by the throat diameter. The smaller this throat diameter is the higher the pressure for a given gas flow. This increased pressure has the benefit of increasing heat transfer from the hot combustion gas to the feed stock material, usually a powder, and also increasing the pressure in the converging gas and feed stock region. Therefore, particles can reach the desired temperature and velocity without the use of an accelerating gas.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1A:
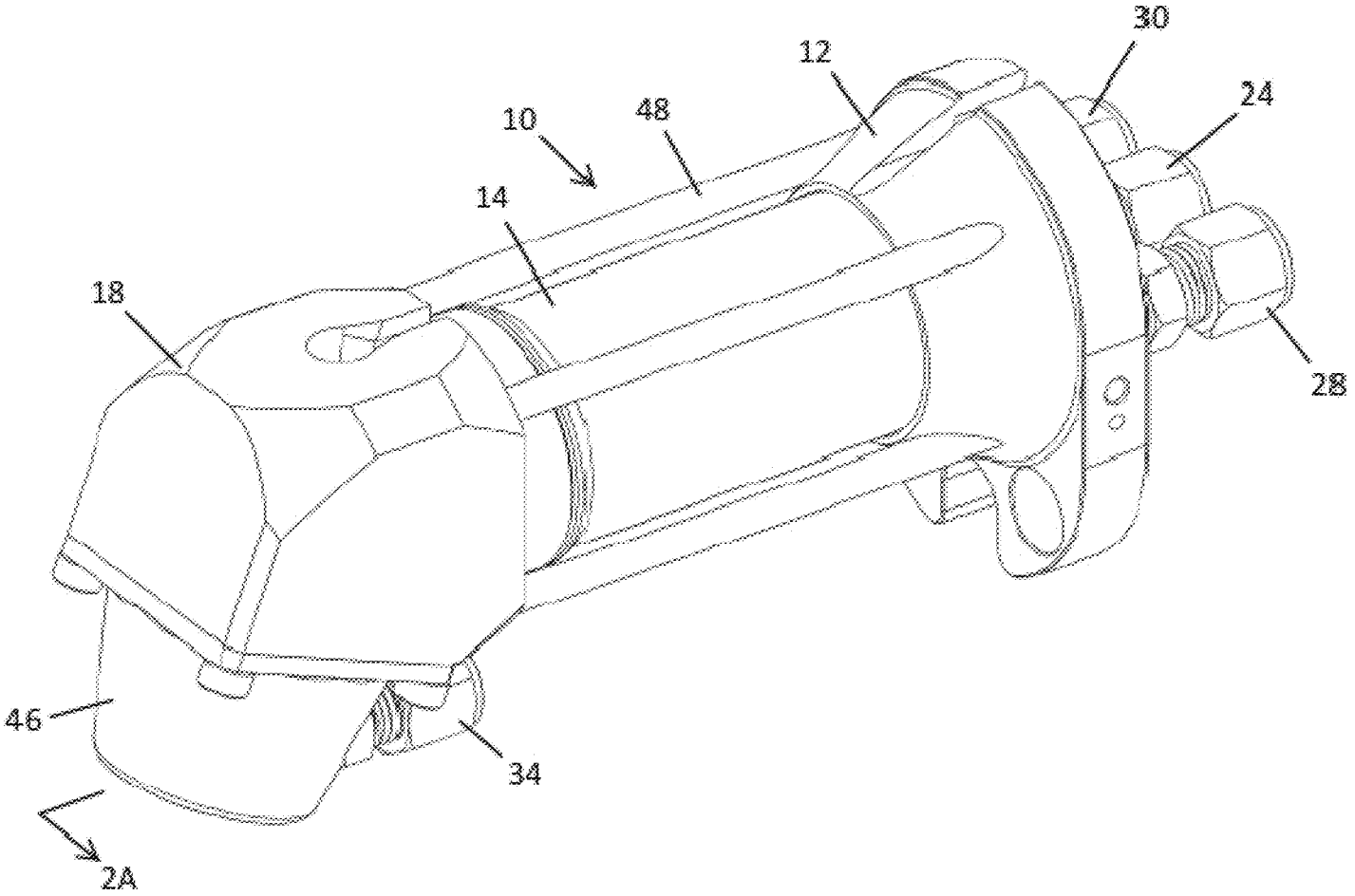
FIG. 1A is an isometric view of a water cooled thermal spray gun with exterior powder feed line and coolant water return line removed for illustrative purposes.
Figure 2A:
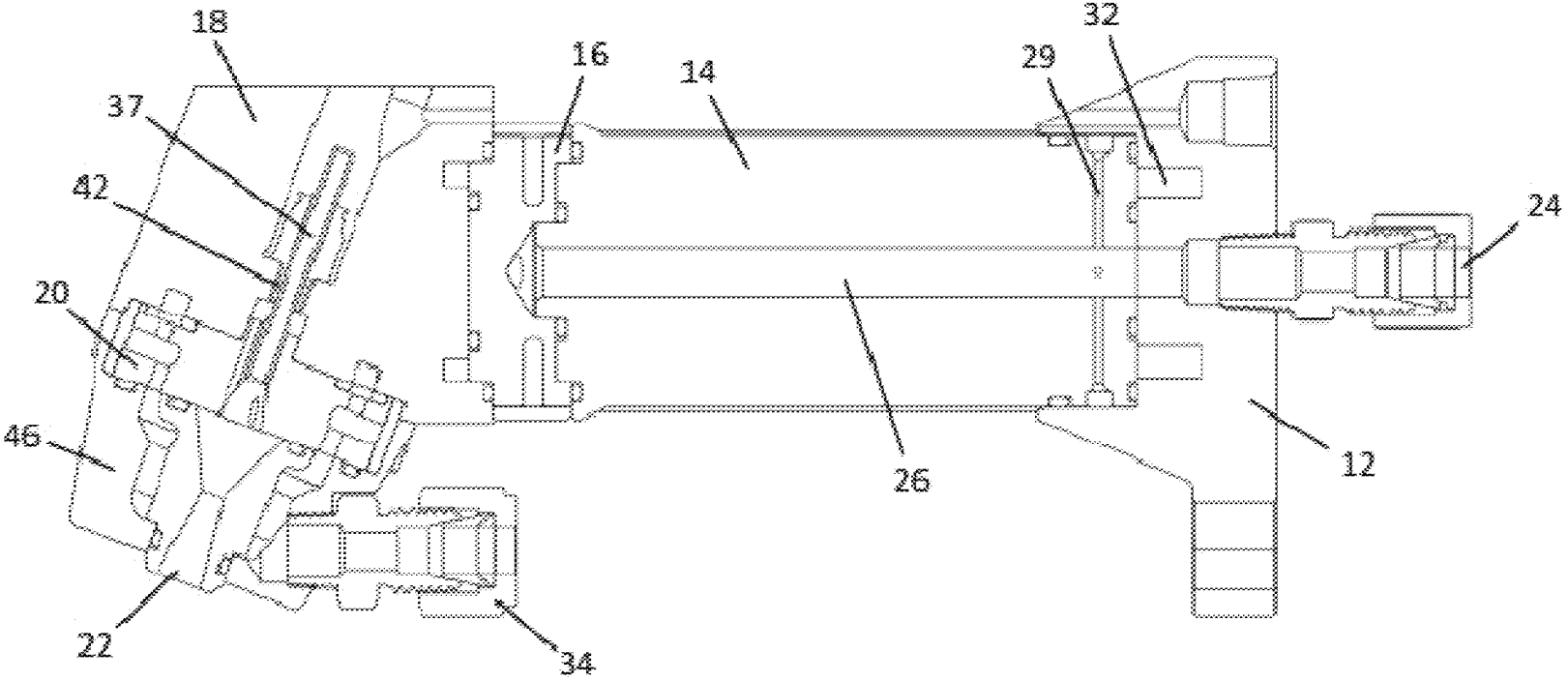
FIG. 2A is a longitudinal vertical cross-sectional view of the thermal spray gun shown in FIG. 1A taken along line 2A of FIG. 1A.
Figure 4B:
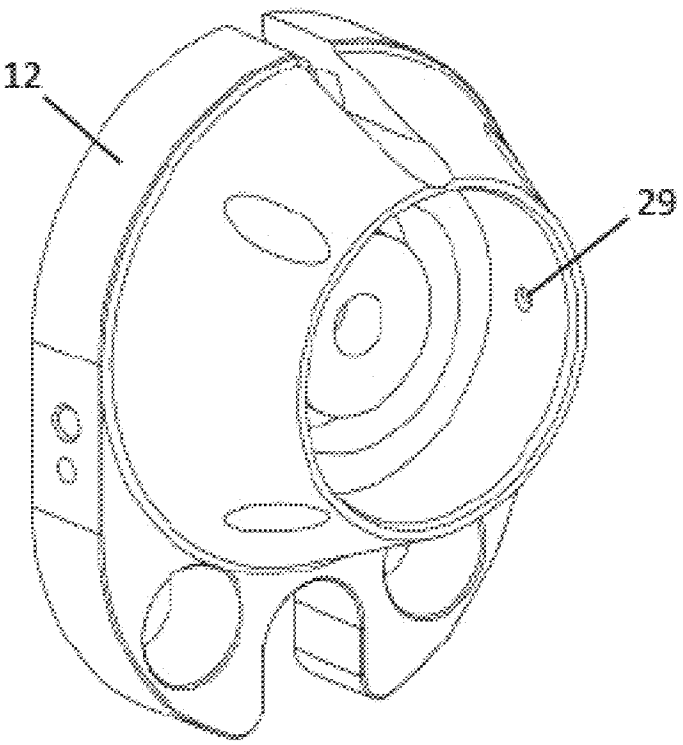
FIG. 4B is a left front isometric view of the base plate in isolation.
Figure 4A:
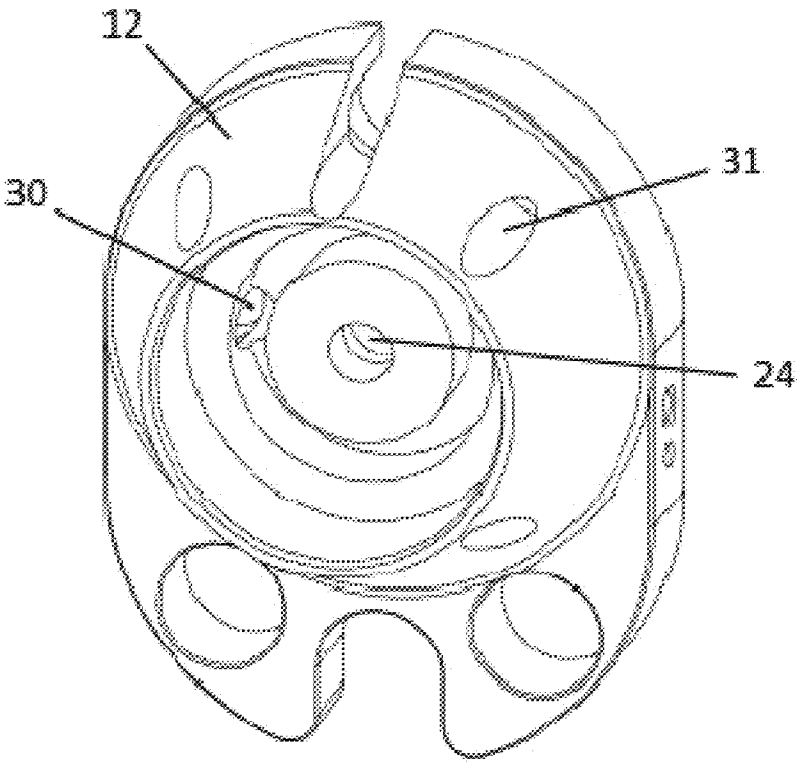
FIG. 4A is a top front isometric view of the base plate in isolation.
Figure 9:
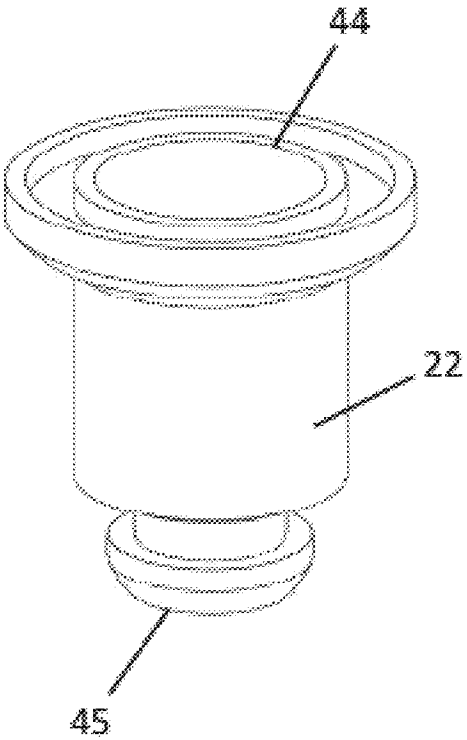
FIG. 9 is a front isometric view of the nozzle of the thermal spray gun in isolation.
Figure 10:
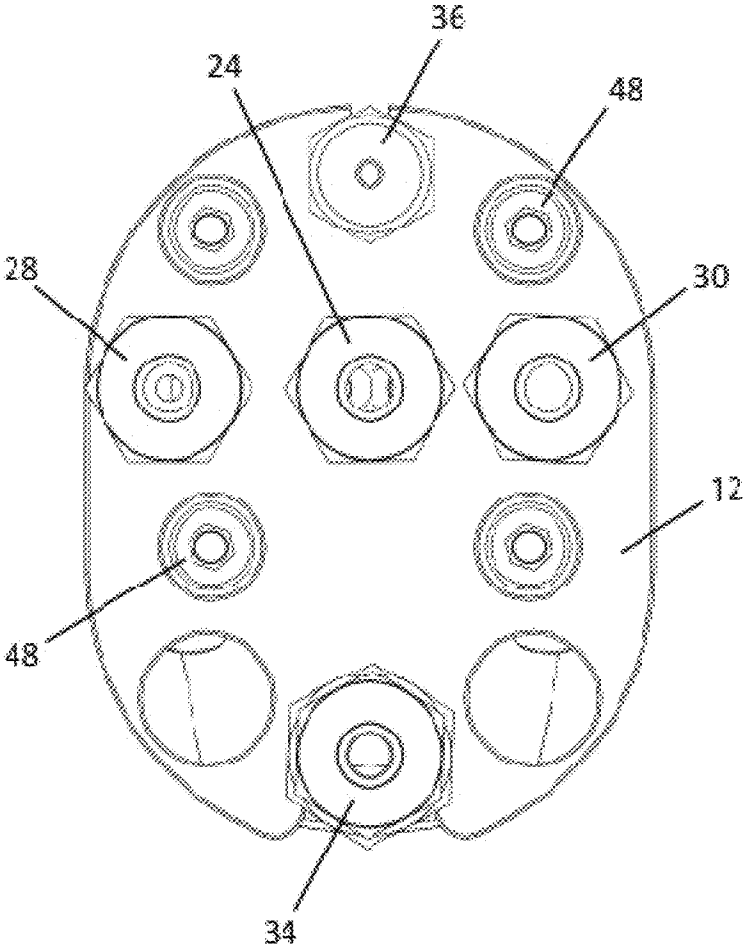
FIG. 10 is a rear view of the thermal spray gun.

With reference to FIG. 1A, in which the exterior powder feed line and coolant water line are removed for illustrative purposes the novel High Velocity thermal spray gun to spray wear and corrosion-resistant coatings 10 has a base plate 12 in which are located various input passages and chambers. It includes a combustion chamber 14, divergence section 16, elbow housing 18, convergence assembly 20 (FIG. 7A, 7B) and nozzle 22 (FIG. 2A, FIG. 9). Nozzle 22 is retained in nozzle housing 46. Rigid tie rods 48 strengthen the torch body, by connecting base plate 12 at mounting holes 31 (FIG. 4A) to the elbow housing 18. Water cooling, entering or leaving through water line 30, 34 is preferred but air and/or $CO_2$ cooling may also be incorporated through the use of an accelerating fluid such as gas that goes through recuperative heating while cooling the torch. In the illustrated embodiment in FIG. 1A an accelerating gas enters the gas stream through passages 50, 52 into the convergence area around the powder feed injection port 39 as described below. Hydrogen is the preferred fuel, however other fuel gases such as methane, ethylene, ethane, propane, propylene or liquid fuels such as kerosene, ethanol or diesel can be used. The feed stock may be powder, wire, liquid or a suspension of powder in liquid.

Figure 1B:
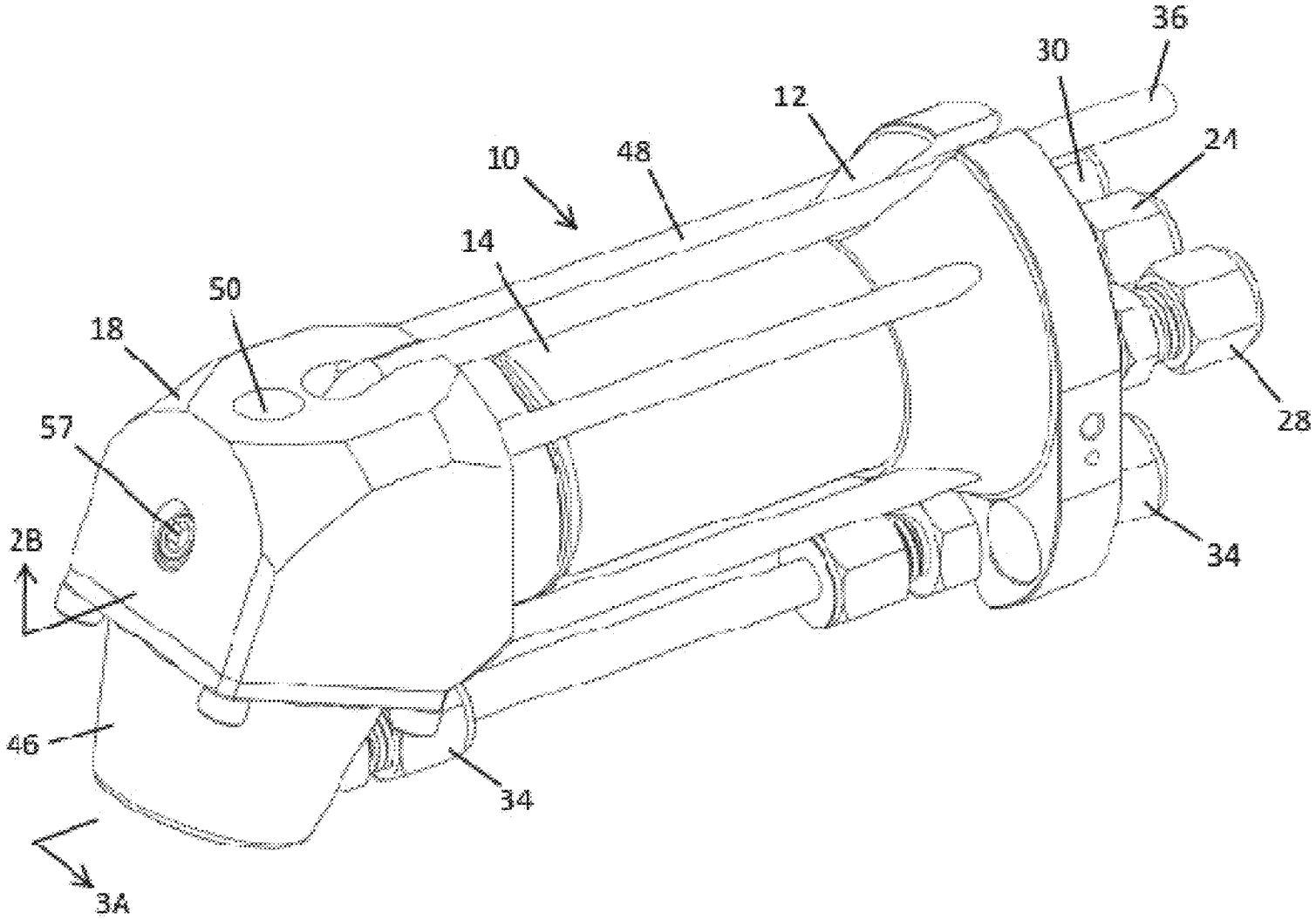
FIG. 1B is an isometric view of a water cooled thermal spray gun with a convergence accelerating gas port.
Figure 3A:
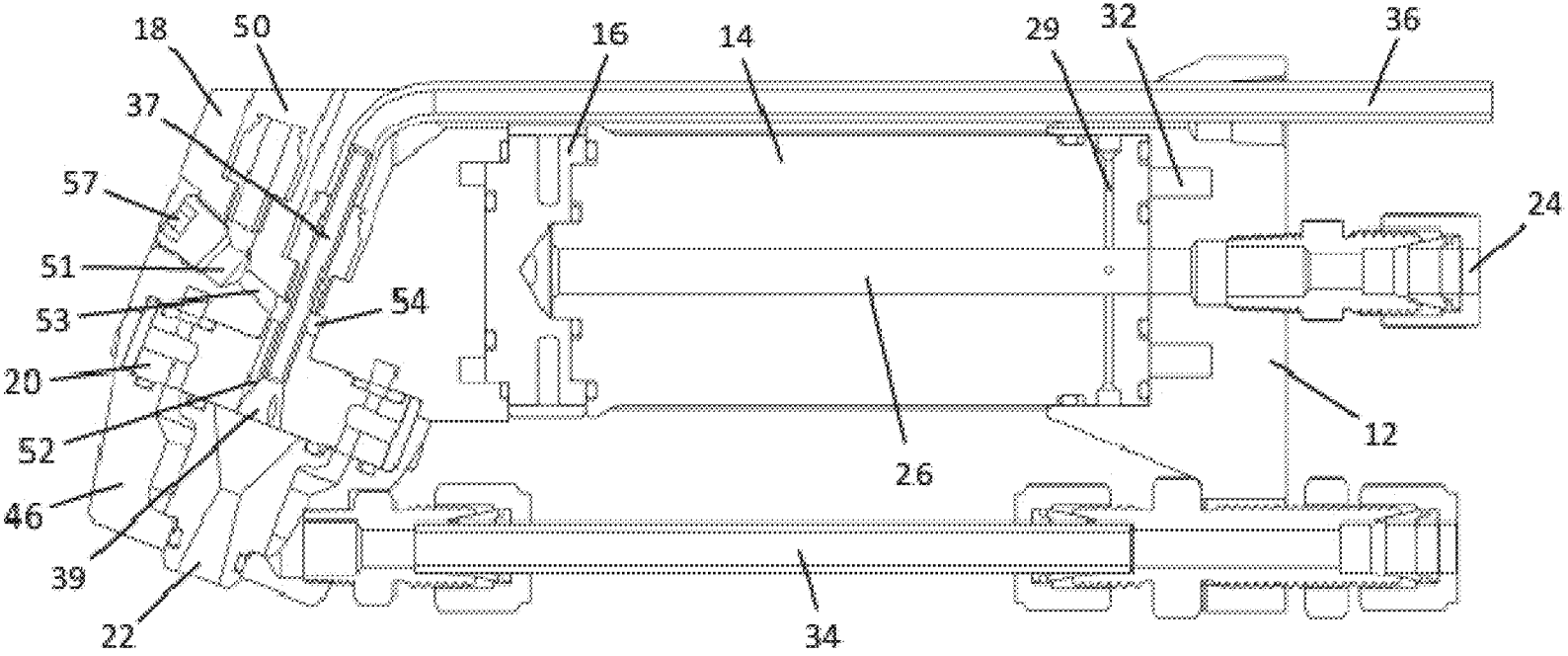
FIG. 3A is a longitudinal vertical cross-sectional view of the thermal spray gun shown in FIG. 1B taken along line 3A of FIG. 1B.

With reference to FIGS. 1B and 3A, wherein the same reference numerals are used to reference the same parts as in FIG. 1A, the novel High Velocity thermal spray gun to spray wear and corrosion-resistant coatings incorporating use of a high density and/or fuel accelerating gas is shown at 10. It has a base plate 12 in which are located various input passages and chambers. It includes a combustion chamber 14, divergence section 16 (FIG. 6A, 6B), elbow housing 18, convergence assembly 20 (FIG. 7A, 7B) and nozzle 22 (FIG. 3A, FIG. 9). Nozzle 22 is retained in nozzle housing 46. Rigid tie rods 48 fix the torch body, by connecting base plate 12 at mounting holes 31 (FIG. 4A) to the elbow housing 18. Water cooling is preferred but air and/or $CO_2$ cooling may also be incorporated through the use of an accelerating fluid such as gas that goes through recuperative heating while cooling the torch. In the illustrated embodiment, the accelerating gas enters the gas stream through passages 50, 52 into the convergence area around the powder feed injection port 39 as described below. Hydrogen is again the preferred fuel, however other fuel gases such as methane, ethylene, ethane, propane, propylene or liquid fuels such as kerosene, ethanol or diesel can be used.

Figure 2B:
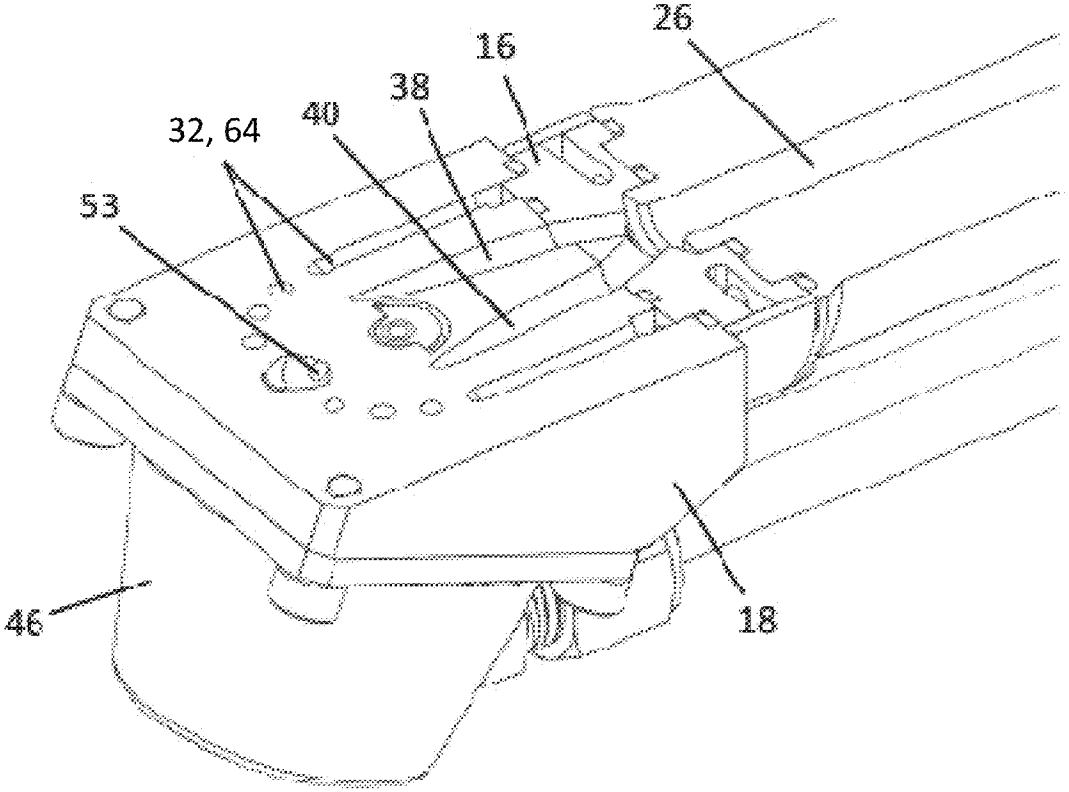
FIG. 2B is a detail horizontal cross-section view along line 2B of FIG. 1B in phantom outline to show the multiple streams of combustion product, accelerating gas and powder feed upstream of the nozzle.
Figure 3B:
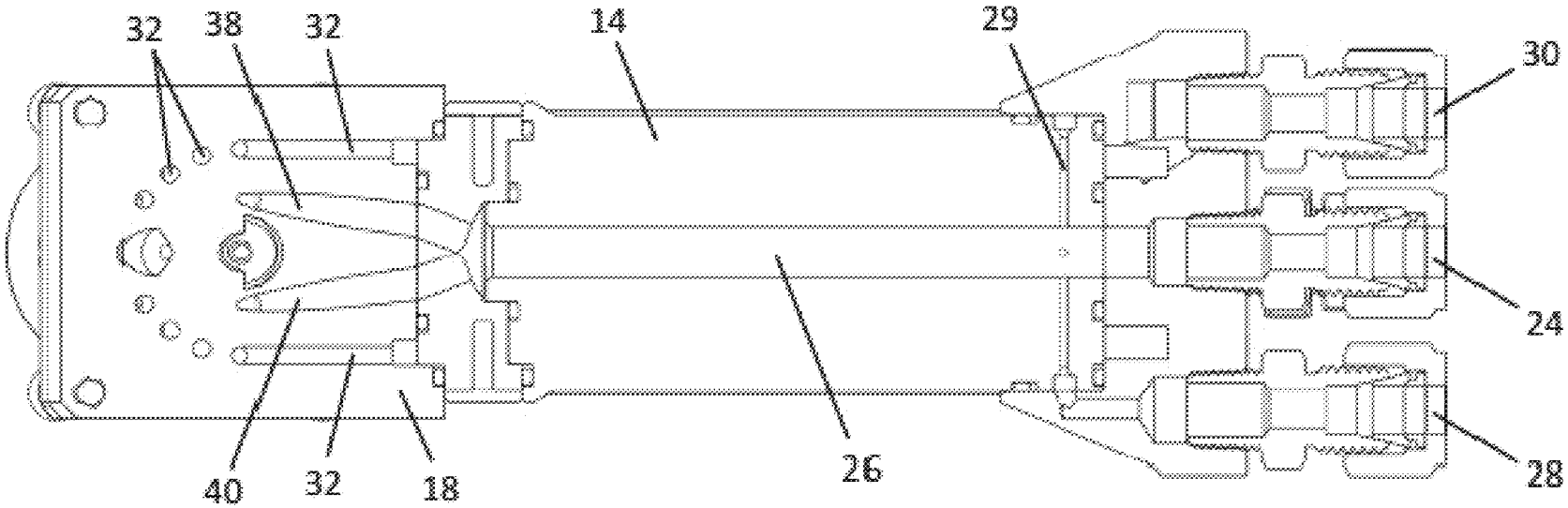
FIG. 3B is a plan view of a longitudinal horizontal cross-sectional view of the thermal spray gun shown in FIG. 1B taken along line 2B of FIG. 1B.
Figure 13A:
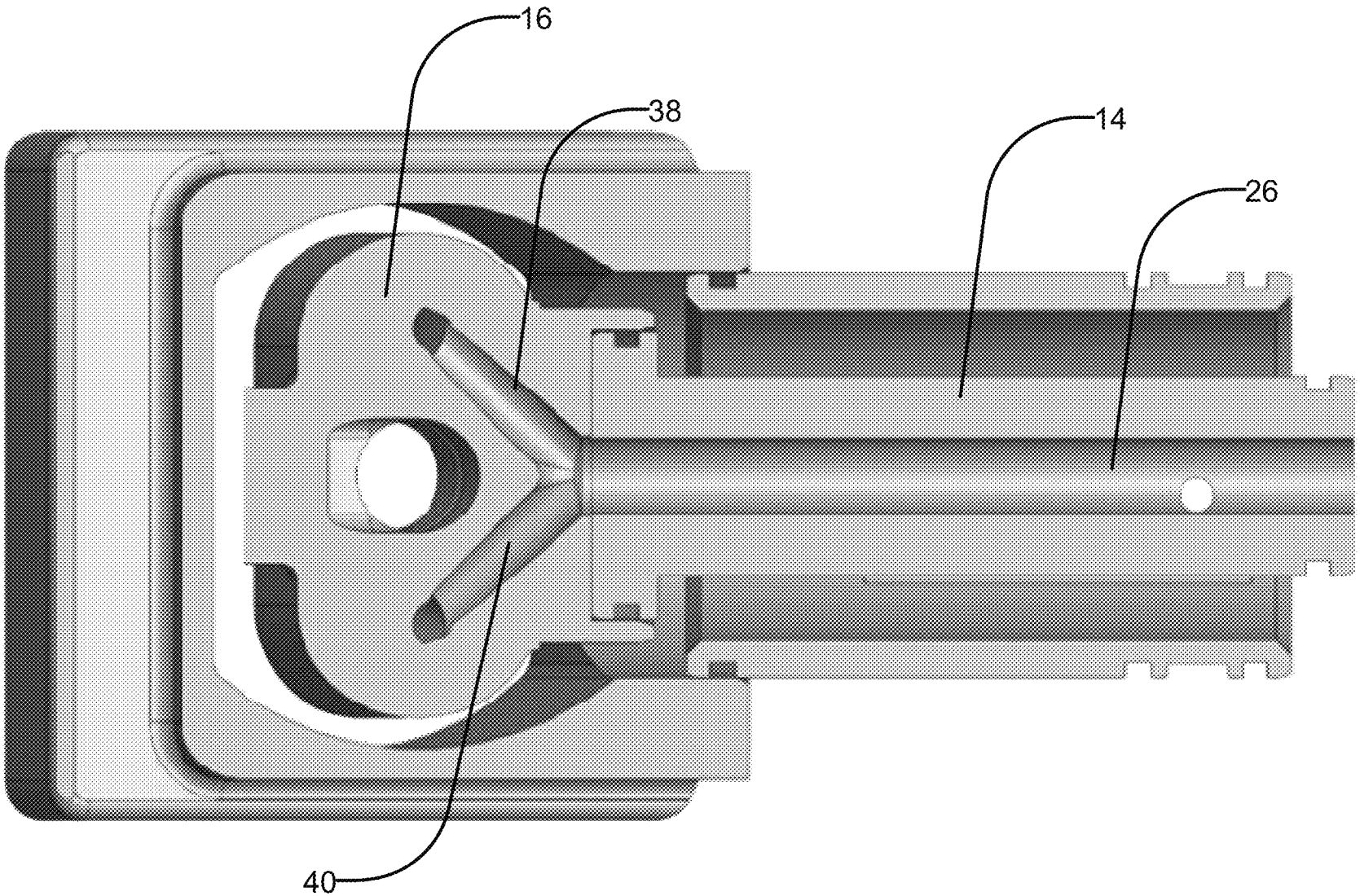
FIG. 13A shows a combustion chamber and a divergence section according to an example embodiment.
Figure 13B:
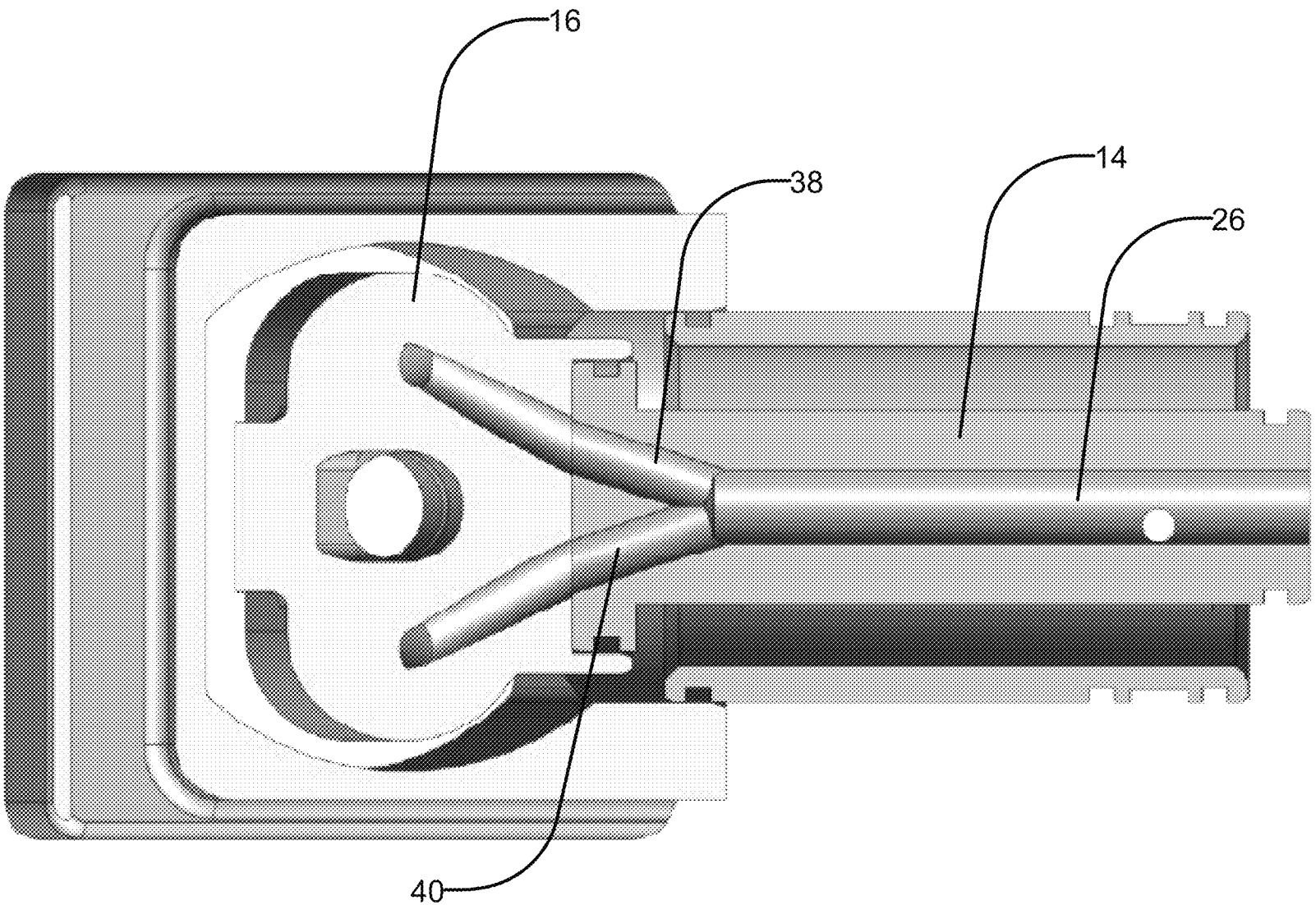
FIG. 13B shows a combustion chamber and a divergence section according to another example embodiment.

Hydrogen gas or fuel enters central channel 24 (FIG. 3A) which communicates with central passage 26 of combustion chamber 14. In some embodiments, the combustion stream in passage 26 is diverted in divergence section 16 into two channels 38, 40 which pass through elbow 18 (FIG. 2B, 3B, 13A). In such embodiments, divergence section 16 may be integrally formed with elbow 18. In other alternative embodiments, the combustion stream is diverted into two channels 38, 40 in passage 26 before the diverted combustion stream passes through divergence section 16 (FIG. 13B). In such embodiments, divergence section 16 may be integrally formed with combustion chamber 14.

Figure 11:
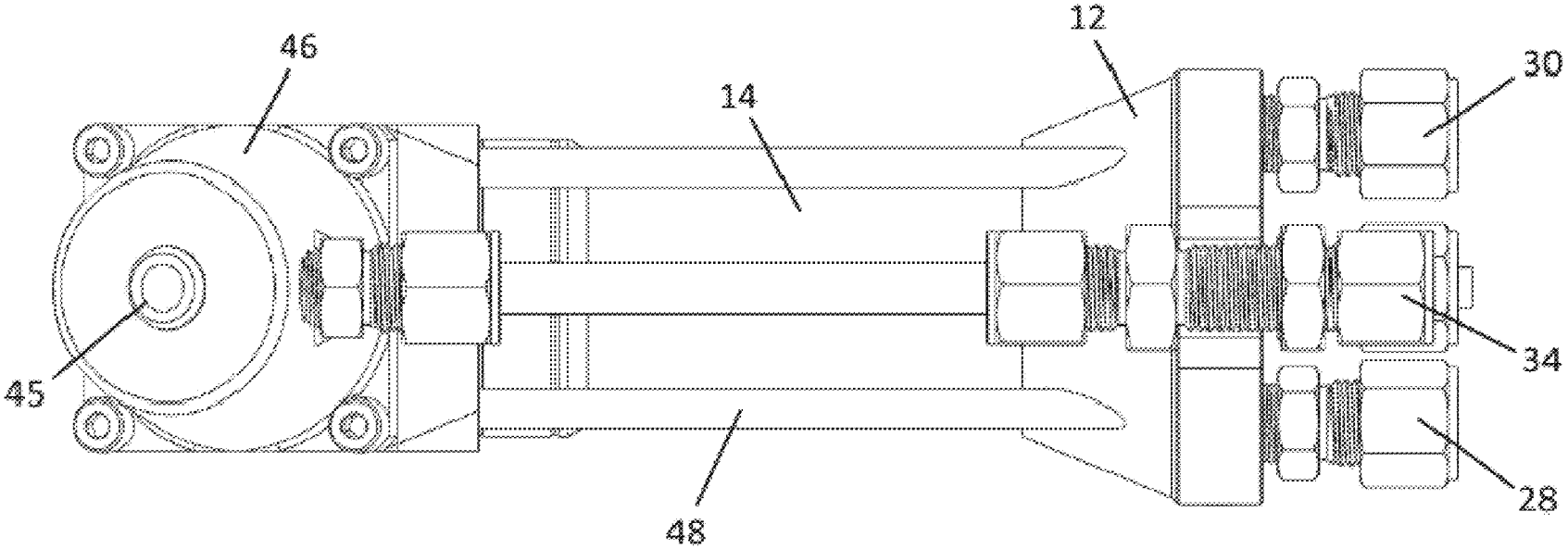
FIG. 11 is a bottom view of the thermal spray gun.

Coolant water enters (or leaves) the torch body at 30 (FIG. 11) and passes through passageways 32 (FIG. 5A) and exits (or enters) the torch body through line 34. In some embodiments, passageways 32 are defined by or otherwise comprise longitudinal passages 60 extending through combustion chamber 14 (FIG. 5A), axial passages 62 extending through divergence section 16 (FIG. 6A, 6B), elbow cooling fluid passages 64 extending through elbow housing 18 (FIG. 2B), and body passages 66 extending through convergence section 20 (FIG. 7A, 7B, 8A, 8B).

Figure 5B:
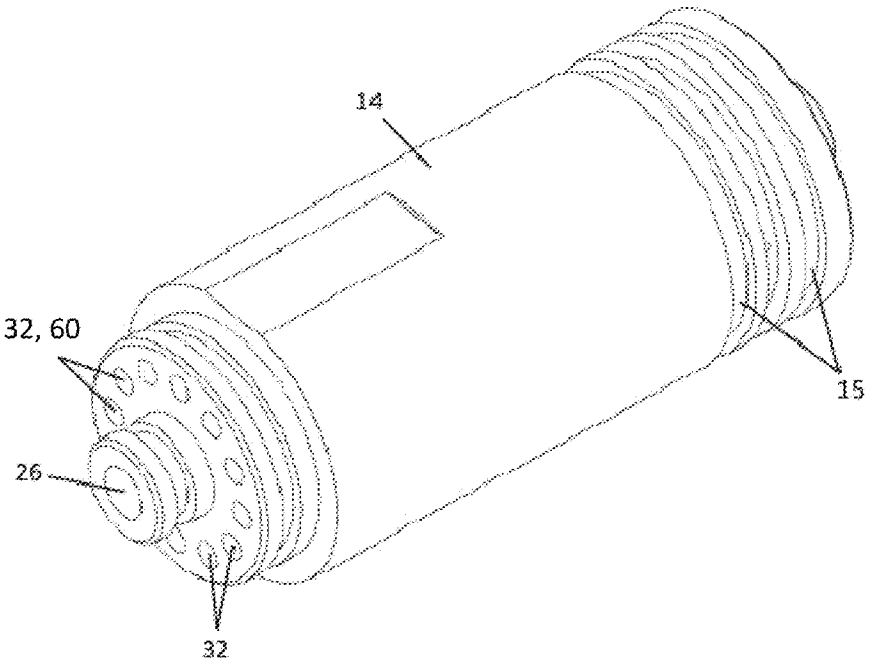
FIG. 5B is an alternate embodiment of the combustion chamber shown in FIG. 5A using radial seals.
Figure 5A:
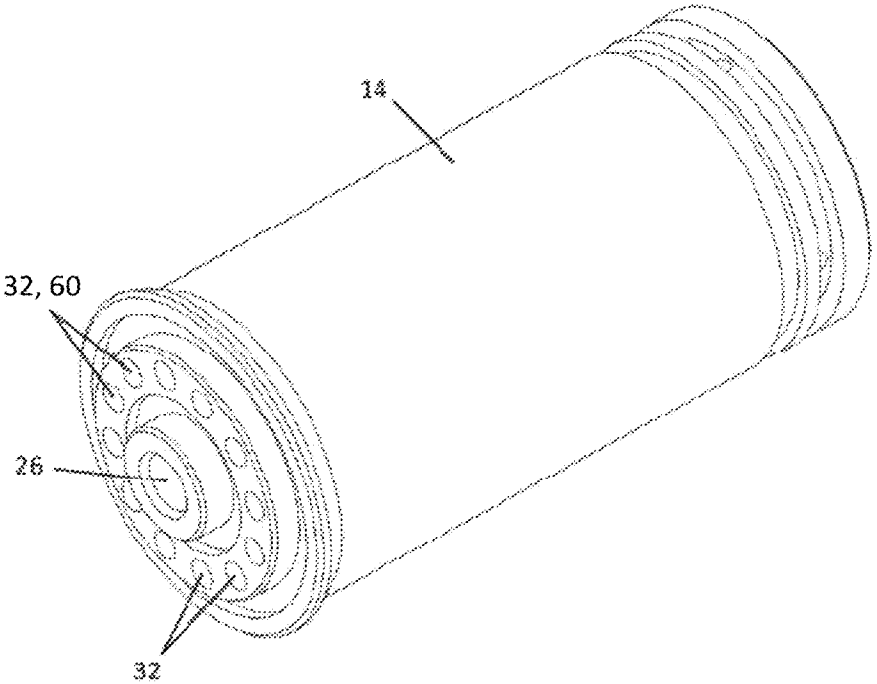
FIG. 5A is a front isometric view of the combustion chamber in isolation.
Figure 5C:
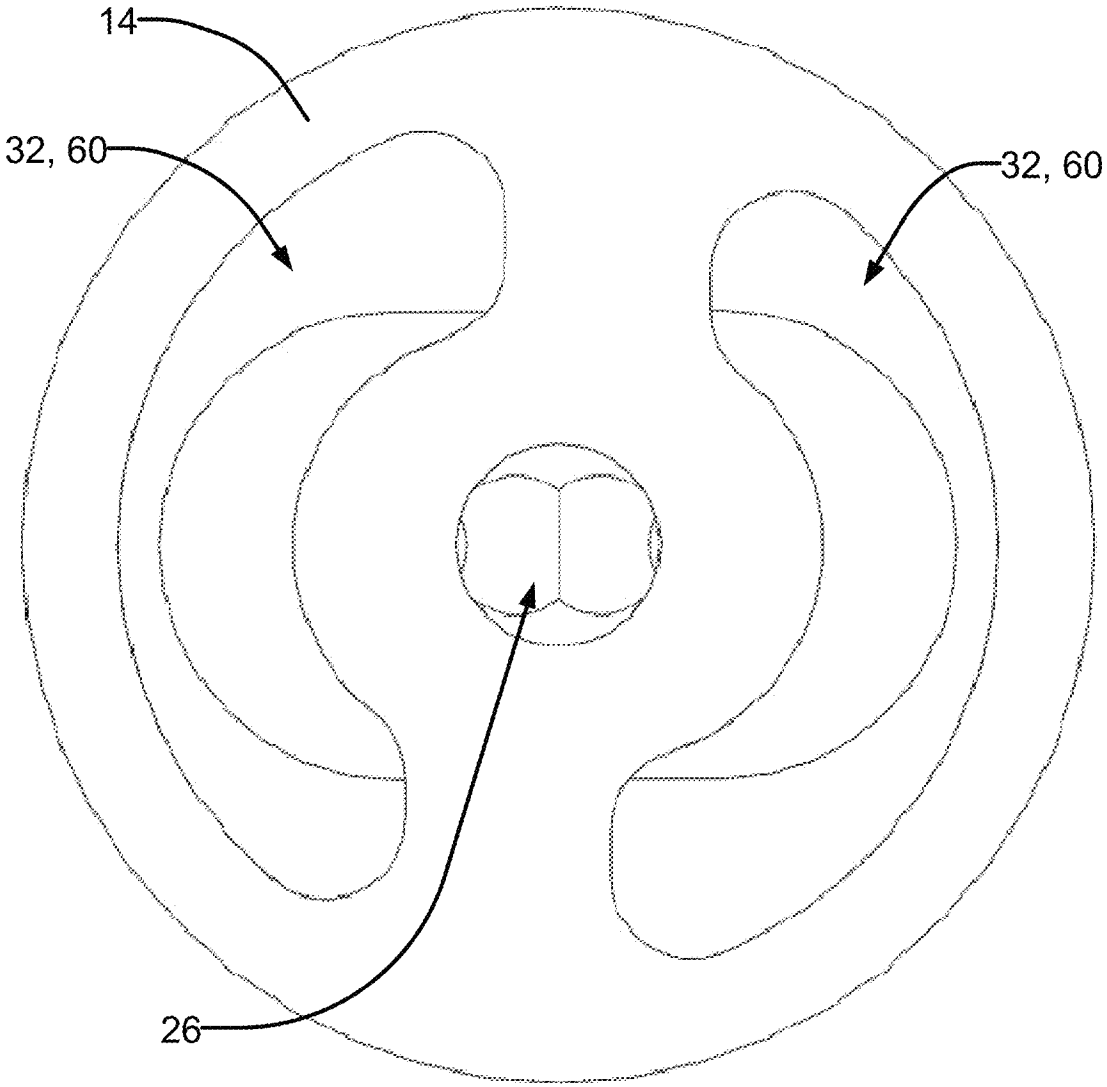
FIG. 5C is an end view of an alternate embodiment of the combustion chamber shown in FIG. 5A having crescent shaped cooling passages.

As shown in FIGS. 5A-B, combustion chamber 14 comprises a plurality of longitudinal passages 60 extending therethrough. Each longitudinal passage 60 is in direct fluid communication with water line 30. Longitudinal passages 60 extend in a direction generally parallel to the longitudinal axis of combustion chamber 14. Longitudinal passages 60 may be located around the circumference of central passage 26. For example, combustion chamber 14 may comprise twelve longitudinal passages 60 that are spread circumferentially around central passage 26 as shown in FIGS. 5A-B. Longitudinal passages 60 may be tubular shaped (FIGS. 5A-B) or crescent shaped (FIG. 5C) although this is not necessary.

Figure 6B:
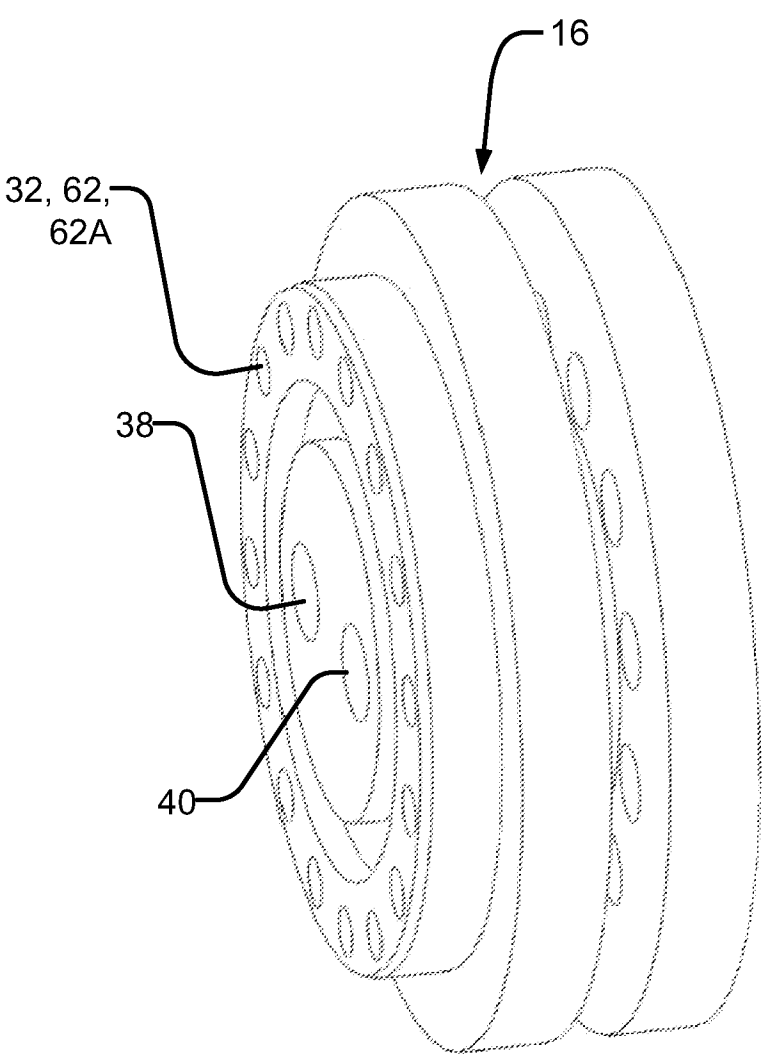
FIG. 6B is a front perspective view of the divergence section of the thermal spray gun in isolation.
Figure 6A:
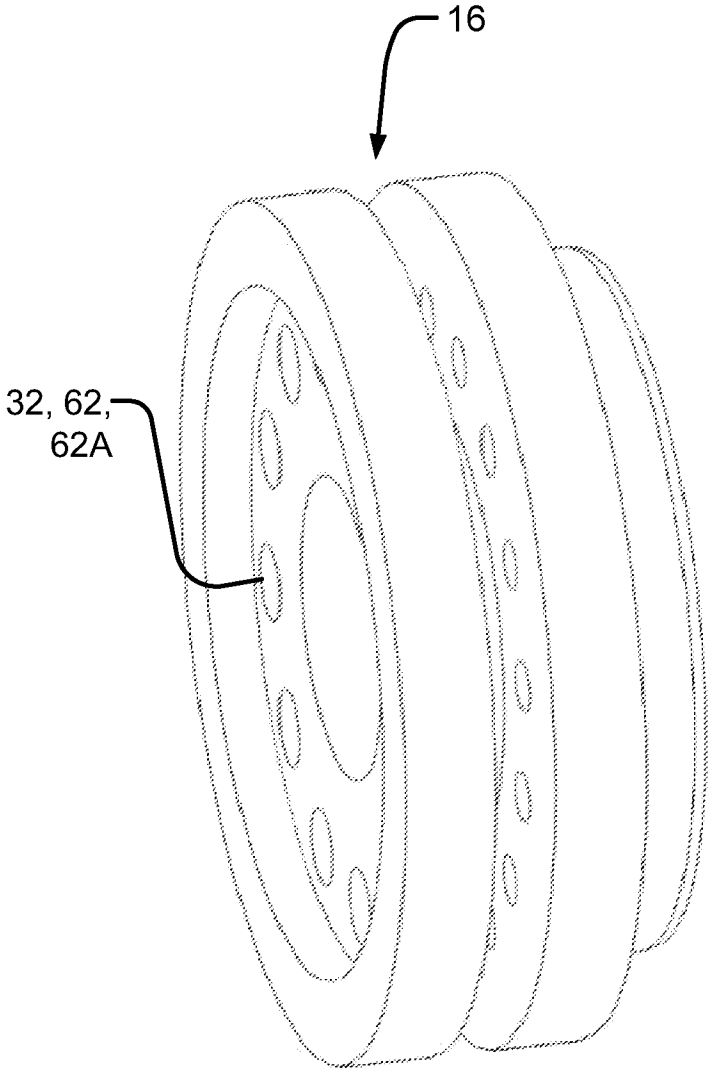
FIG. 6A is a rear isometric view of the divergence section of the thermal spray gun in isolation.

As shown in FIGS. 6A-B, divergence section 16 comprises a plurality of axial passages 62 extending therethrough. Each axial passage 62 is located downstream of and in direct fluid communication with one or more longitudinal passages 60. Axial passages 62 extend in a generally axial direction (i.e. in a direction generally parallel to longitudinal passage 60) through divergence section 16. Each axial passage 62 is defined by or otherwise includes a rear end 62A facing combustion chamber 14 (FIG. 6A) and a front end 62B facing elbow housing 18 (FIG. 6B). Two or more axial passages 62 may share a common rear end 62A as long as they do not share a common front end 62B. For example, divergence section 16 may comprise sixteen axial passages 62 located between twelve rear ends 62A and sixteen front ends 62B. In some embodiments, the number of axial passages 62 is greater than the number of longitudinal passages 60. In other embodiments, the number of axial passages 62 is the same as the number of longitudinal passages 60 (FIGS. 6A-B). Axial passages 62 may be tubular shaped or crescent shaped to conform to the shape of longitudinal passages 60 although this is not necessary.

Figure 8B:
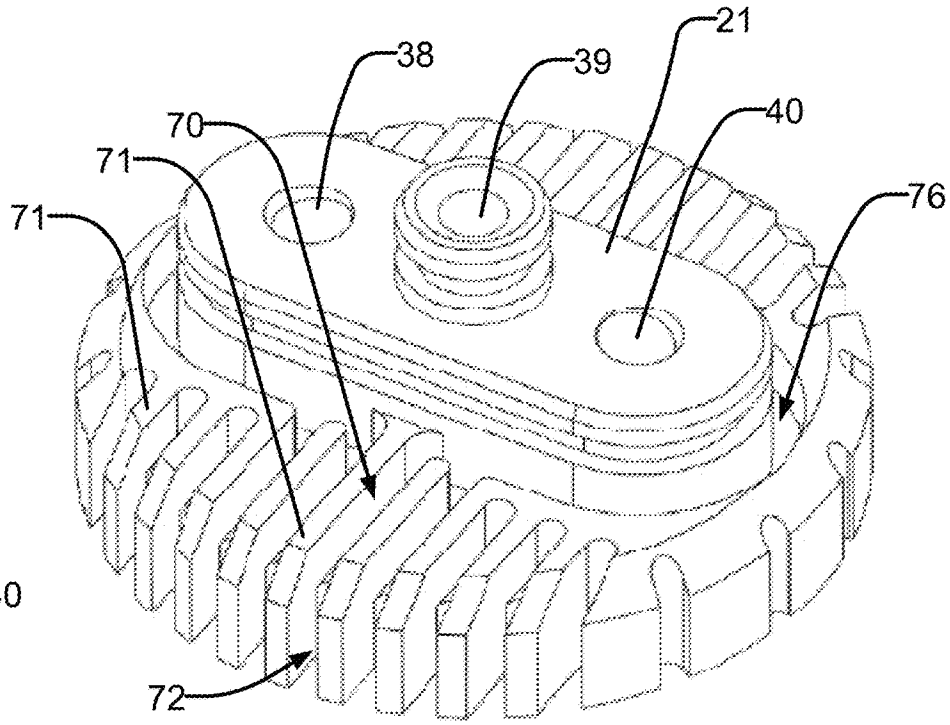
FIG. 8B is a perspective view of the FIG. 8A convergence section in isolation.

As shown in FIG. 2B, elbow 18 comprises a plurality of elbow cooling fluid passages 64 extending therethrough. Each elbow cooling fluid passage 64 is located downstream of and in direct fluid communication with one or more axial passages 62. Elbow fluid cooling passages 64 may be curved relative to the longitudinal axis of combustion chamber 14. In some embodiments, elbow fluid cooling passages 64 are curved relative to the longitudinal axis of combustion chamber 14 by an angle greater than 30 degrees. In some embodiments, elbow cooling passages 64 are curved to conform to the curvature of channels 38, 40 (FIG. 8C). This can provide improved cooling to the areas around channels 38, 40.

Figure 7B:
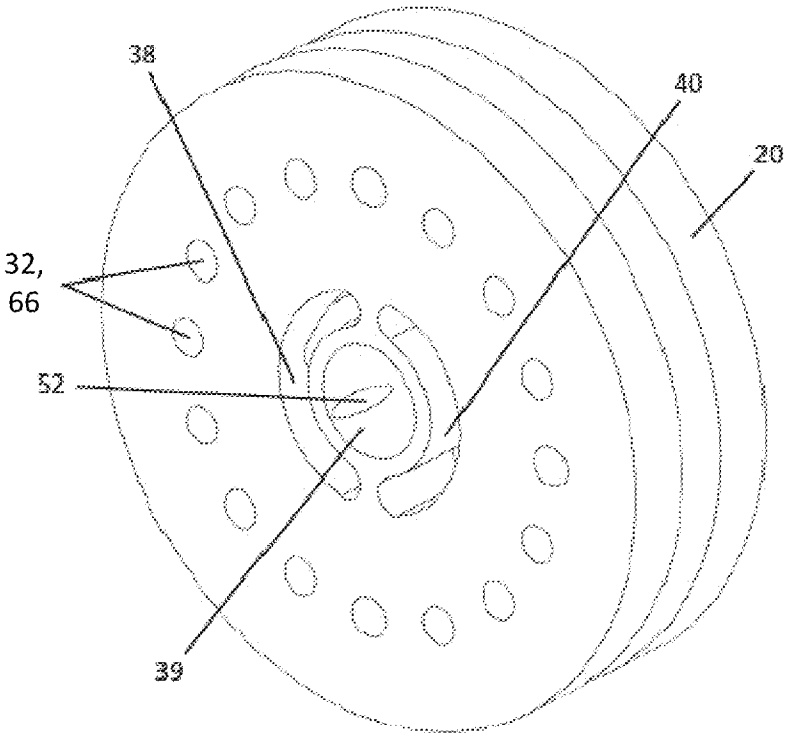
FIG. 7B is a front isometric view of the FIG. 7A convergence section in isolation.
Figure 7A:
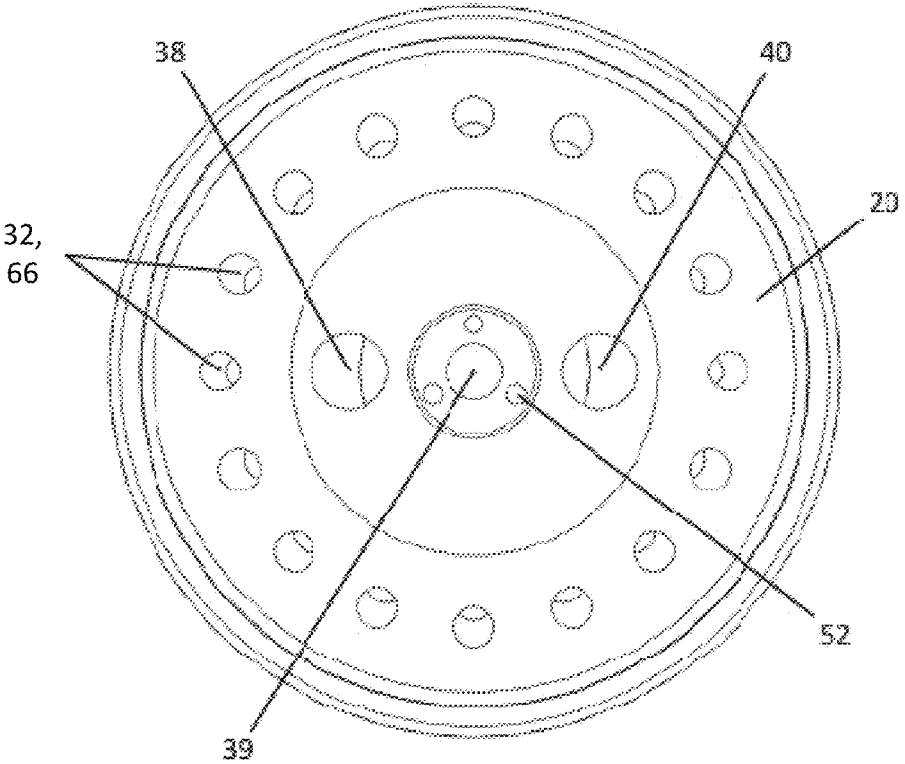
FIG. 7A is a rear view of an example embodiment of the convergence section of the thermal spray gun with accelerating gas in isolation.

Convergence section 20 comprises a plurality of body passages 66 that form part of passageways 32. Each body passage 66 is located downstream of and in direct fluid communication with one or more elbow passages 64 and water line 34. In some embodiments, body passages 66 are tubular shaped and extend in a generally axial direction (i.e. in a direction generally parallel to the longitudinal axis of powder feed tube 37) through the body of convergence section 20 (FIGS. 7A-B). In other embodiments (e.g. see FIGS. 8A-C), body passages 66 include slots 72 formed around the circumferential edge of convergence section 20, grooves 70, and/or transverse passages 76 (i.e. passages that facilitate fluid flow in directions generally orthogonal to the longitudinal axis of powder feed tube 37). As described in more detail below, coolant flow paths through body passages 66 can in some cases be controlled through the physical coupling between convergence section 20 and elbow section 18.

Figure 8A:
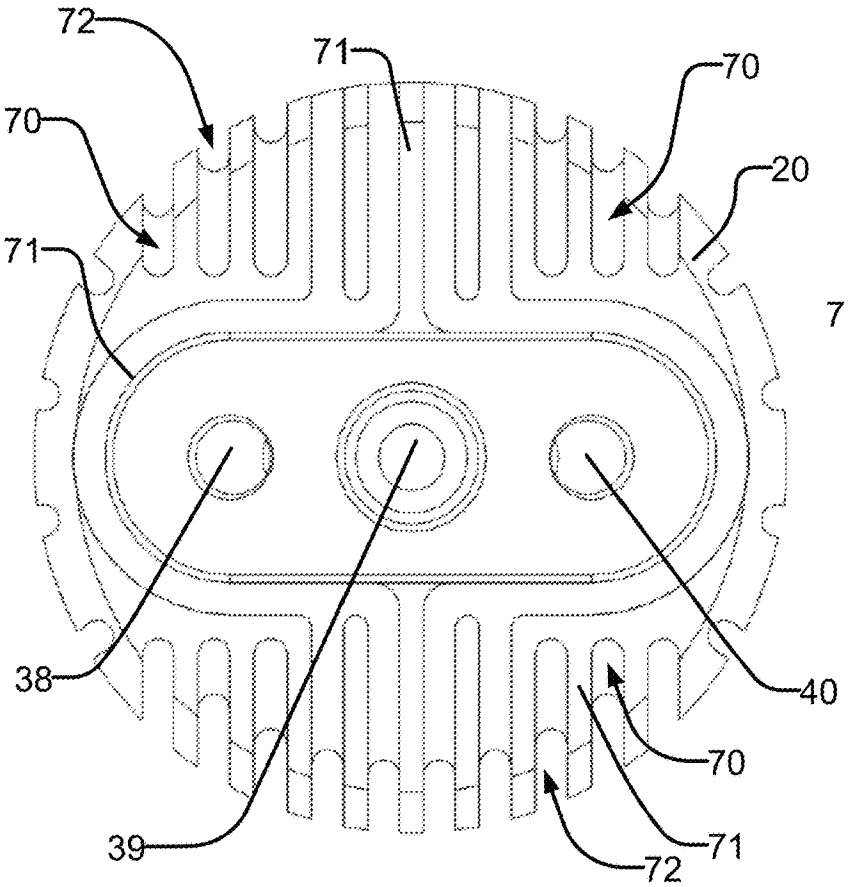
FIG. 8A is a plan view of another example embodiment of the convergence section of the thermal spray gun in isolation.
Figure 8D:
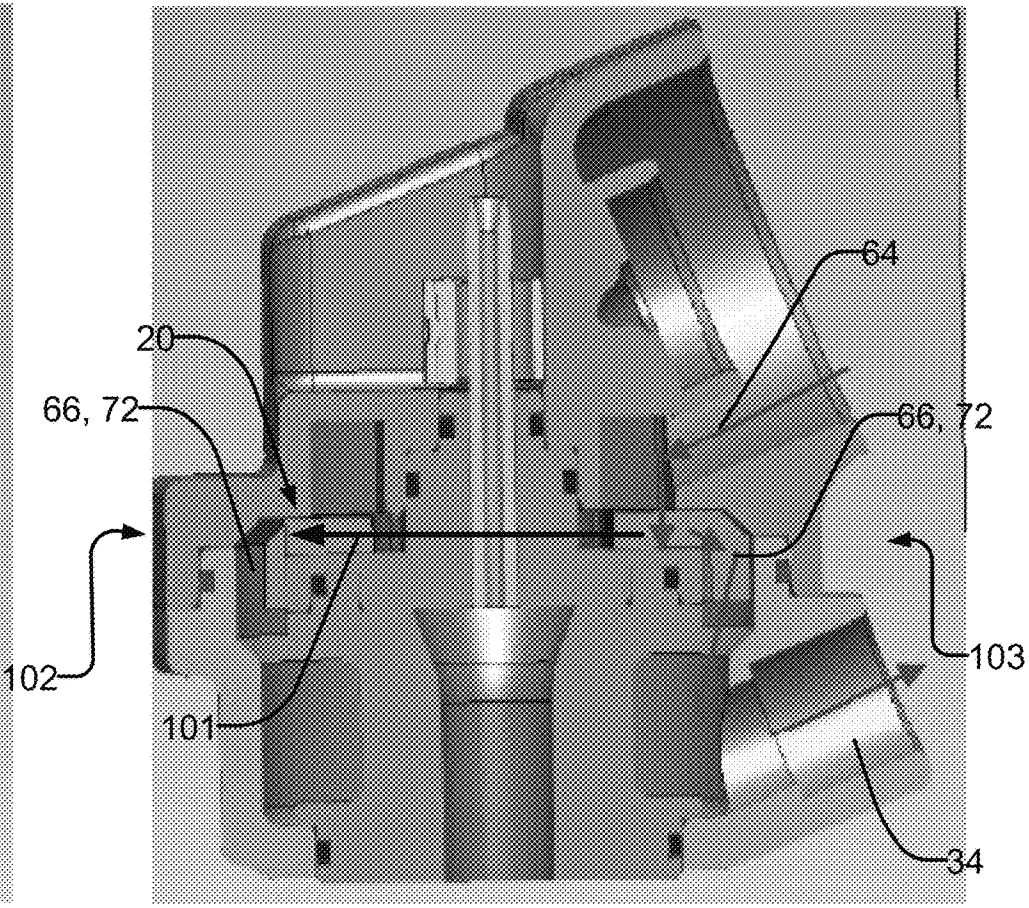
FIG. 8D is a side sectional view of the FIG. 8C elbow section.
Figure 8C:
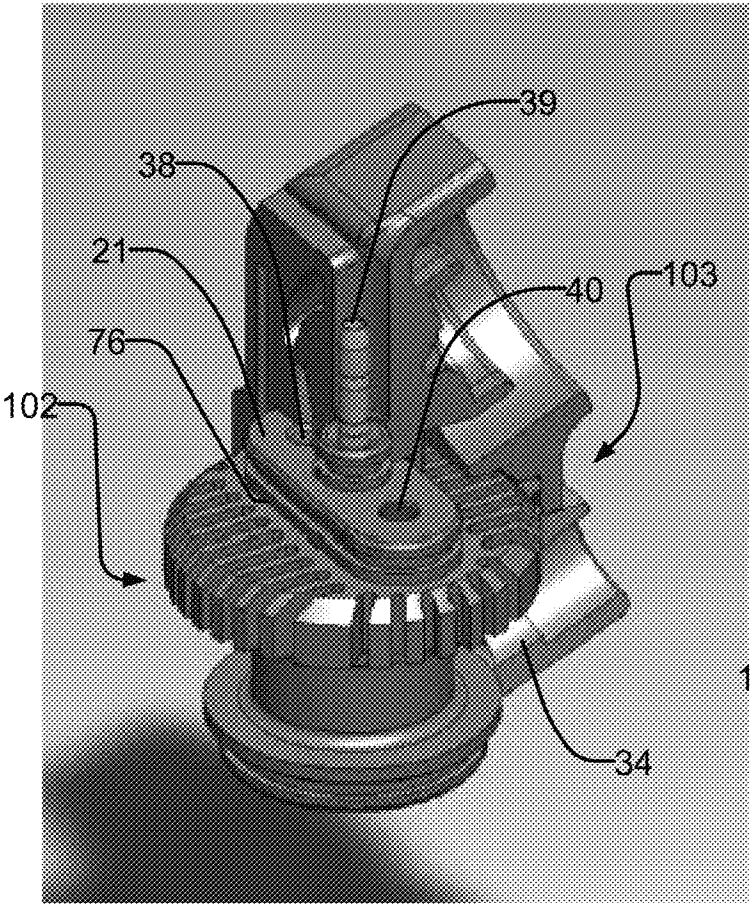
FIG. 8C is a perspective view of the interior of an elbow section of the thermal spray gun which houses the FIG. 8A convergence section.

FIG. 8A illustrates the convergence section 20 of torch 10 according to an example embodiment. Convergence section 20 may be adapted for use with both HVOF torches and HVAF torches. For the purposes of facilitating the description, it is assumed that coolant (e.g. water) enters torch 10 from line 30 of combustion chamber 14 and exits torch 10 through line 34 of nozzle housing 46. Convergence section 20 is retained between elbow 18 and nozzle housing 46. Convergence section 20 comprises powder feed injection port 39 and hot gas channels 38, 40 for the diverted hot gas combustion stream to converge and flow therethrough, as described in more detail elsewhere herein. Convergence section 20 comprises a plurality of grooves 70 interspaced between a plurality of fins 71 (FIGS. 8A-C). The interspaced grooves 70 and fins 71 are formed on the top side (i.e. the side facing toward elbow section 18) of convergence section 20. That is, grooves 70 and fins 71 face toward elbow section 18. Grooves 70 and fins 71 extend in a direction generally perpendicular to the longitudinal axis of powder feed tube 37. Advantageously, fins 71 provide increased surface area to facilitate good heat transfer between hot gas flowing through channels 38, 40 and coolant flowing through grooves 70.

Some or all of grooves 70 may be in fluid communication with a respective slot 72. Slots 72 are formed around the circumference of convergence section 20 Slots 72 extend in a generally axial direction (i.e. in a direction generally parallel to the longitudinal axis of powder feed tube 37). Slots 72 are shaped to allow coolant to flow from elbow section 18 through convergence section 20 and into nozzle housing 46. Slots 72 may be arranged to encourage optimized (e.g. balanced) coolant flow through convergence section 20. Since convergence section 20 is subject to extreme heat due to hot gas flowing through channels 38 and 40, encouraging optimized coolant flow through convergence section 20 can be desirable.

Figure 8F:
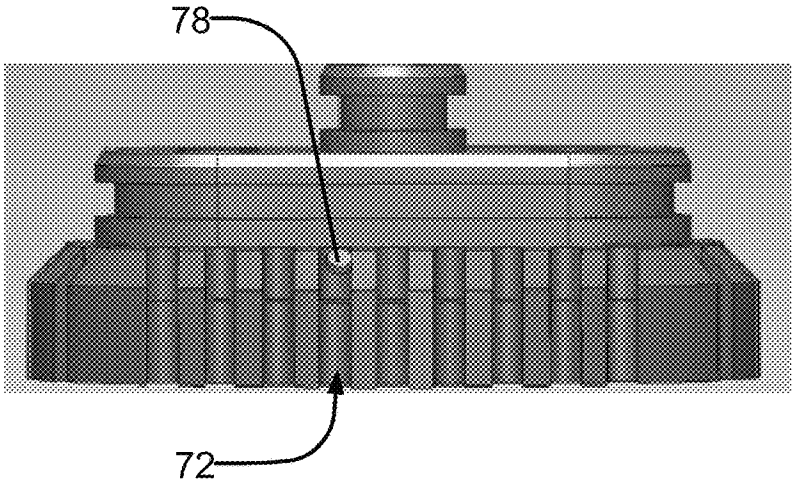
FIG. 8F is a side view the FIG. 8A convergence section with an optional water cooling hole.
Figure 8E:
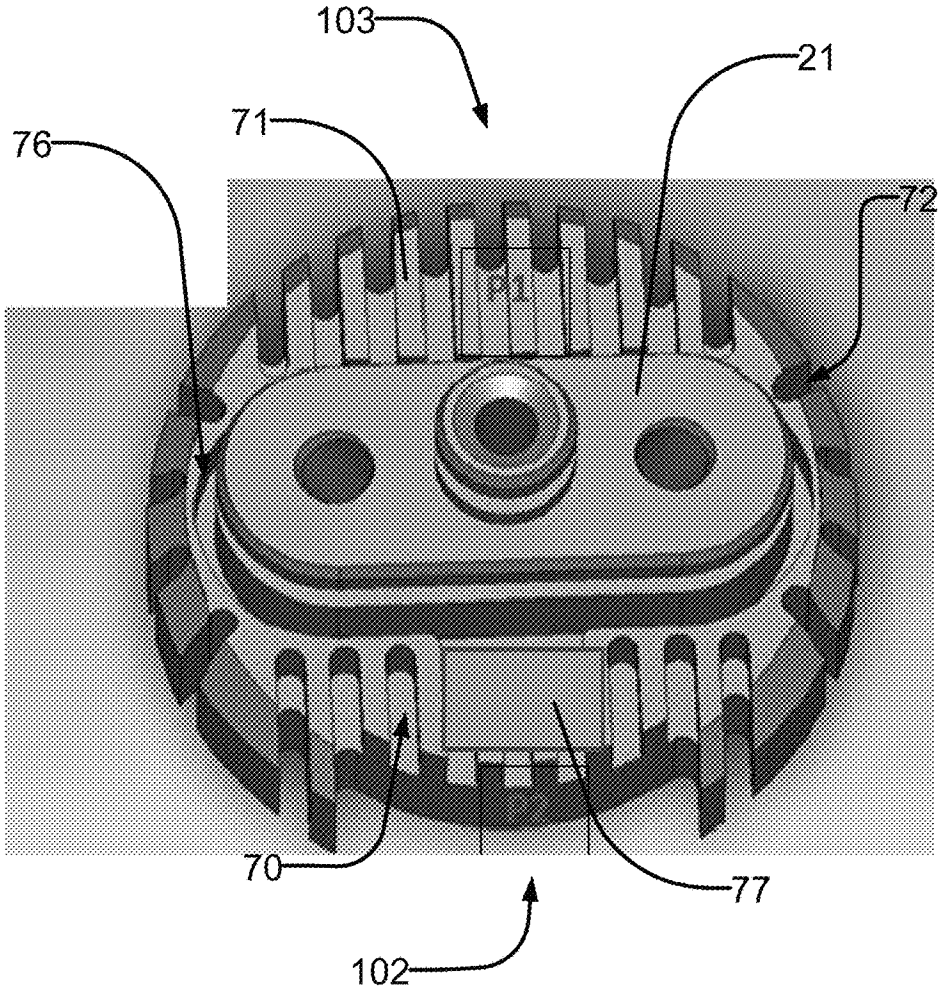
FIG. 8E is an elevation view of the FIG. 8A convergence section with an optional cover.

The location of grooves 70 and fins 71, the spacing of grooves 70 and fins 71, and/or the size of slots 72 can be configured to guide the water coolant to flow across the fin and groove pattern (i.e. from front side 103 to back side 102 as shown in FIG. 8E) to enhance cooling of convergence section 20. In some embodiments, grooves 70 may be arranged to provide improved cooling around O-rings and/or seals. Controlling water flow path through convergence section 20 can improve cooling, thereby allowing torch 10 to be operated at higher powers.

In some embodiments, convergence section 20 comprises transverse passages 76 that facilitate fluid flow across convergence section 20. For the purposes of facilitating the description, the term "across" (as used in this context) refers to a direction that is generally orthogonal to the direction of extension of slots 72 (e.g. direction 101 as shown in FIG. 8D). Transverse passages 76 may be in fluid communication with one or more grooves 70 (FIG. 8B). In the example embodiment shown in FIG. 8B, some of grooves 70 are in fluid communication with transverse passage 76 while others are not. This can increase water velocity in transverse passage 76 and/or improve cooling to selected areas (i.e. improve cooling to areas where grooves 70 are in fluid communication with transverse passage 76). Transverse passages 76 are located between elbow 18 and the top of convergence section 20. Transverse passages 76 may be enclosed or otherwise bounded between elbow 18 and the top of convergence section 20 in some cases. This allows water flowing through transverse passages 76 to cool both convergence section 20 and elbow 18. Transverse passages 76 are arranged or otherwise configured to direct water flowing down from elbow passages 64 toward the back side 102 of elbow 18 and convergence section 20 (e.g. to direct water to flow along direction 101). For example, transverse passages 76 may be arranged to connect grooves 70 located at front side 103 to grooves 70 located at the back side 102. Since water line 34 is located at the front side 103 of convergence section 20, water flowing down elbow passages 64 will tend to flow through body passages 66 (e.g. slots 72) located at the front side 103 of convergence section 20 to follow the passage of least resistance. Advantageously, body passages 66 can be configured to constrict water flow through slots 72 located at the front side 103 of convergence section 20 and/or to direct water toward back side 102 to encourage more water to flow through slots 72 located at the back side 102 of convergence section 20A. For example, the number and/or size of slots 72 located at the front side 103 (and in fluid communication with transverse passages 76) can be reduced relative to the number and/or size of slots 72 located at the back side 102 to enhance water movement from front side 103 to back side 102

Figure 8G:
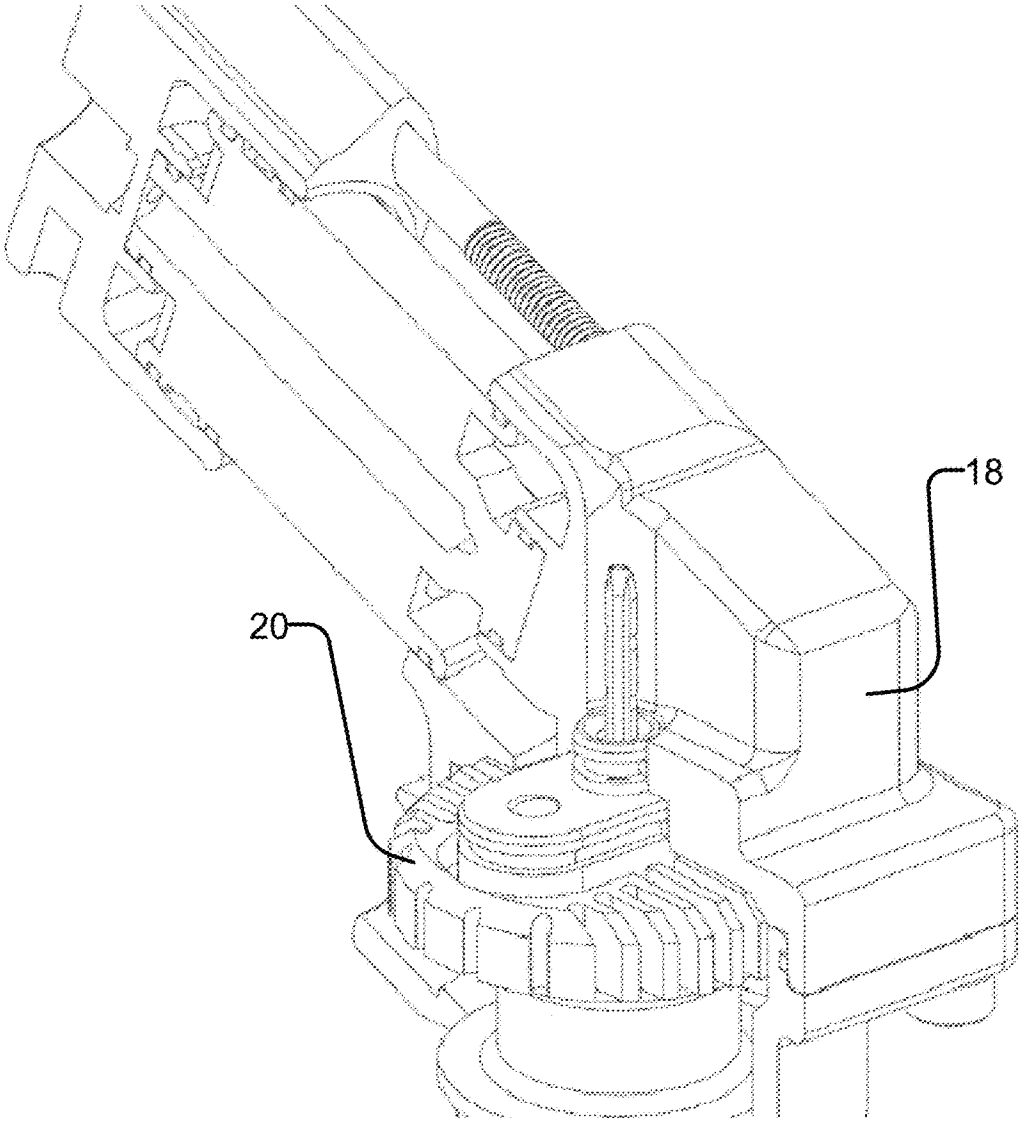
FIG. 8G is a perspective view of the elbow section housing and the FIG. 8A convergence section.

In some embodiments, powder feed injection port 39 and channels 38, 40 extend through a protrusion 21 of convergence section 20 (FIG. 8C). In such embodiments, transverse passages 76 may be arranged to extend or otherwise curve around protrusion 21. For example, transverse passages 76 may be arranged to form an obround shape around protrusion 21 as shown in FIG. 8E. Water flow across transverse passages 76 can be increased by increasing the pressure differential between the back side 102 of convergence section 20 and the front side 103 of convergence section 20. In some embodiments, the top of some or all of the grooves 70 located at the back side 102 of convergence section 20A is covered by a cover 77, or the like (FIG. 8E). Cover 77 can be a part of elbow 18 that extends to contact the top of fins 71 (FIG. 8G), thereby enclosing grooves 70 in effect. Enclosing grooves 70 located at the back side 102 of convergence section 20 in this manner (e.g. enclosing grooves 70 with a bounding solid) can reduce the pressure at the back side 102 of convergence section 20 partly due to the Venturi effect, thereby encouraging water to flow from front side 103 of convergence section 20 through transverse passages 76 to back side 102 of convergence section 20.

In some embodiments, transverse passages 76 include a hole or passage 78 that extend in a transverse direction (e.g. in direction 101) and through protrusion 21. Such hole or passage may be located to place a groove 70 located at front side 103 in fluid communication with a corresponding groove 70 located at back side 102 (FIG. 8F).

While the disclosed embodiment uses water cooling, and air cooling is not incorporated, air cooling and/or $CO_2$ cooling could be used as coolants and air cooling could be added when combined with $CO_2$ as the coolant.

Referring back to FIG. 3A, powder feed line 36 supplies the spray powder or other feedstock such as wire, liquid or a suspension. Oxygen or air enters the combustion chamber through passages 28 and 29 and combusts with the fuel in passage 26 in combustion chamber 14 to form the torch flame. The accelerating gas can also be added through passages 28 and 29. When the accelerating gas is added in this location, it is added after initial combustion in an amount not great enough to extinguish the flame. While the illustrated embodiment shows the use of o-ring seals which seal axially throughout, including the combustion chamber 14 in FIG. 5A, it will be apparent that radial o-ring seals may also be used throughout, as illustrated in the alternate embodiment of the combustion chamber 14 in FIG. 5B, wherein o-rings are seated in co-axial sealing grooves 15.

Air can be used as a replacement for oxygen. In this case the torch becomes a High Velocity Air Fuel (HVAF) torch. The amount of oxygen in air is approximately 21% so the volumetric air flow will be approximately 4.8 times higher to reach the same stoichiometric conditions used for pure oxygen.

Figure 7C:
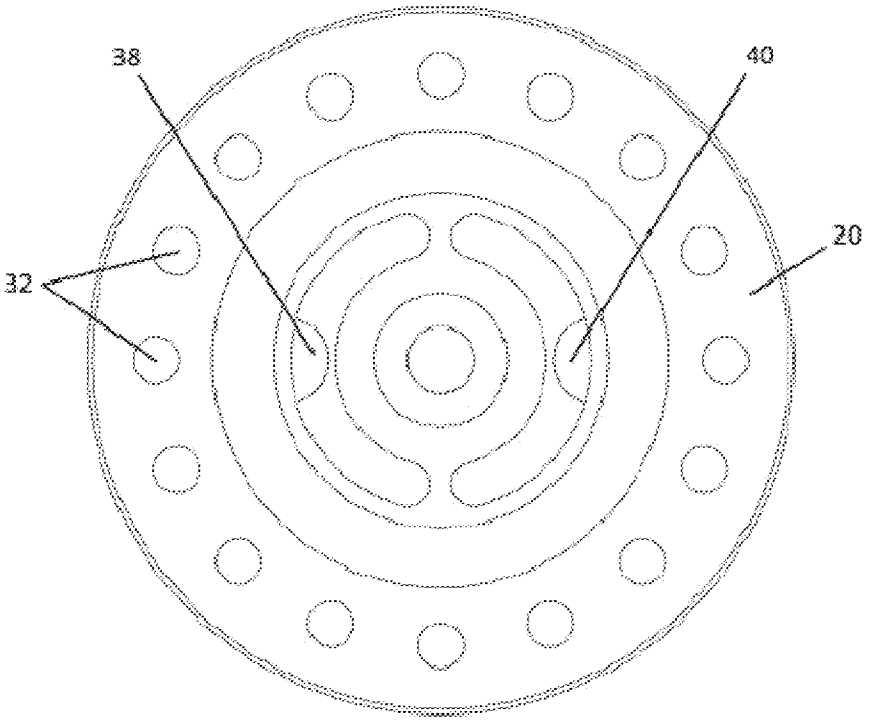
FIG. 7C is a front view of an example embodiment of the convergence section of the thermal spray gun without accelerating gas in isolation.

In some embodiments, the combustion stream in passage 26 is diverted in divergence section 16 into two channels 38, 40 which pass through elbow 18 (FIG. 2B, 3B, 13A). In other alternative embodiments, the combustion stream is diverted into two channels 38, 40 in passage 26 before the diverted combustion stream passes through divergence section 16 (FIG. 13B). Powder feed tube 37 is a stainless steel or tungsten carbide tube attached to the convergence assembly 20. It is supplied by powder feed line 36 which is a synthetic polymer hose, preferably a Teflon™ hose which fits over the end of powder feed tube 37. In some cases a metal powder feed tube is preferred. The metal tube can be made from materials such as stainless steel, copper or brass. Powder feed tube 37 passes through powder channel 42 in elbow 18 (FIG. 2A) and communicates through powder feed injection port 39 in convergence assembly 20 (FIG. 7A) into the center of nozzle entrance 44. Channels 38, 40 open into a crescent shape in cross-section within the convergence assembly 20 as shown in FIGS. 7B and 7C and converge around the entry point of powder feed injection port 39 at the nozzle entrance 44.

Figure 12:
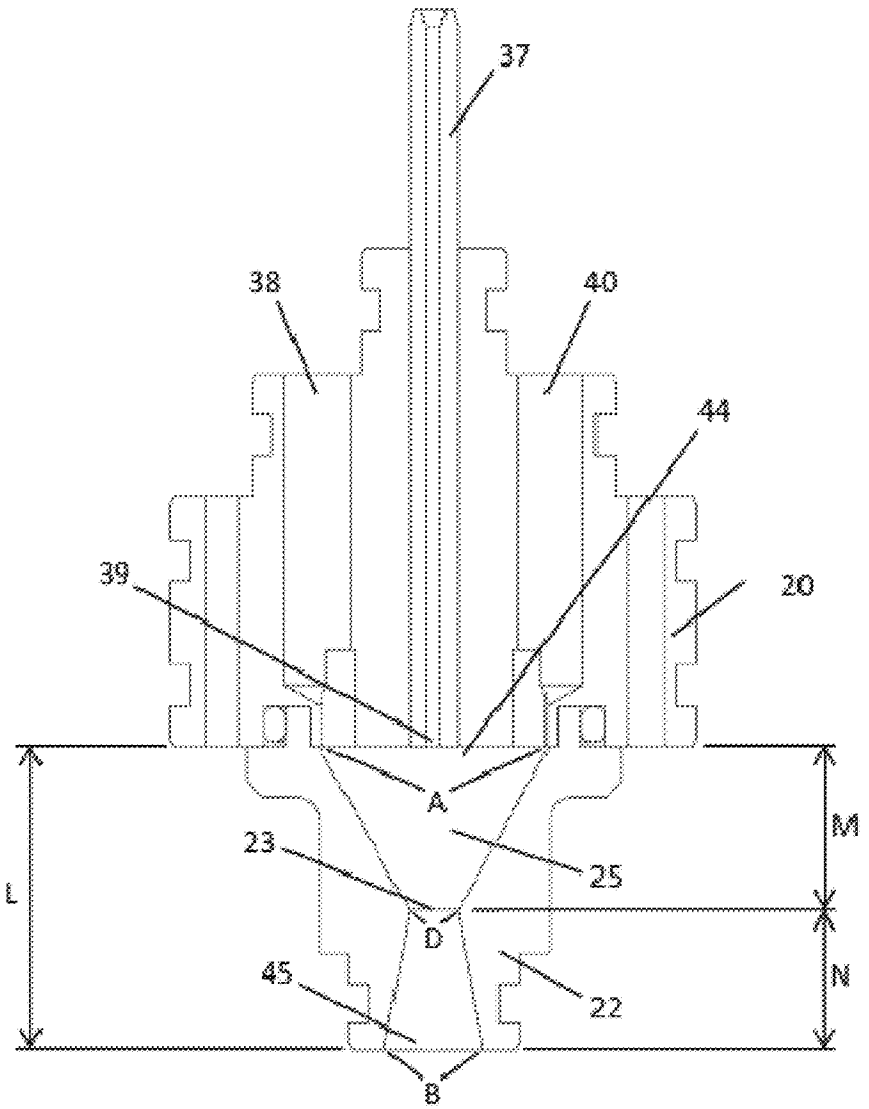
FIG. 12 is a cross-section of the convergence section and an example embodiment of the nozzle assembly.

FIG. 12 shows an example embodiment of a convergence nozzle configuration that creates a higher pressure in the converging nozzle region than would otherwise be the case for a straight nozzle with exit internal diameter. With reference to FIG. 12, the convergence assembly 20 and nozzle 22 are shown in cross-section. Nozzle 22 has throat 23, injection zone 25, entrance 44, exit 45, entrance diameter A, exit diameter B, total length L, throat diameter D, converging length M and diverging length N. Powder feed tube communicates through powder feed injection port 39 in convergence assembly 20 into the center of nozzle entrance 44. Channels 38, 40 converge around the entry point of powder feed injection port 39 at the nozzle entrance 44.

The following equations characterize particle velocity and temperature that are important to the thermal spray process Rate of Acceleration $$\frac{dv_p}{dt} = \frac{1}{2m_p} C_D \rho_g A_P (v_g - v_p)|v_g - v_p|$$

Particle Heat Transfer $$h = k/D_p(2+0.6Re^{0.5}Pr^{0.33})$$

Gas pressure influences both of these in terms of increasing gas density and gas thermal conductivity.

The present invention uses relatively short nozzles at nominal length of approximately 16 mm and 28 mm. The nozzle length is set at less than or equal to about 5 times the nozzle throat (bore) diameter D. With the nozzle length being less than or equal to about 5 times the throat or bore diameter. Total nozzle length L to Throat Bore ratio for different nozzle bore diameters used herein is provided in the following Table 1.

TABLE 1

| Nozzle Dimensions | | |
|---|---|---|
| Nozzle Length L mm | Throat Diameter D mm | Length: Throat ratio |
| 16 | 4 | 4 |
| 16 | 5 | 3.2 |
| 16 | 5.5 | 2.9 |
| 16 | 6 | 2.7 |
| 28 | 5.5 | 5.1 |
| 28 | 6 | 4.67 |
| 28 | 7 | 4.00 |

The injection zone 25 is the area within the torch where the hot gas and feedstock injection come together upstream of the nozzle throat. In the case where the nozzle throat diameter D is the smallest area that hot gas will pass through, the injection zone pressure will be representative of the combustion pressure subject to pressure losses through the elbow 18 and convergence section 20.

For the described embodiment, the high injection pressure increases the gas density and thermal conductivity which results in an increase in heat transfer from the hot gas to the particle. Heat transfer to a particle in thermal spray applications is commonly calculated through the Ranz and Marshall correlation. As can be seen, heat transfer increases with increasing thermal conductivity k, increasing density ρ to the power 0.6. In the pressure ranges 3-15 bar, the viscosity will change very little and can be considered a constant for analysis purposes.

$$Nu = 2 + Re^{0.6}Pr^{0.33} \quad \text{Eq. 1}$$

Nu=Nusselt number=h $D_p$/k
h=heat transfer coefficient
$D_p$=Particle diameter
k=thermal conductivity of the gas $$h = k/D_p(2+Re^{0.6}Pr^{0.33}) \quad \text{Eq. 2}$$

Re=Reynolds Number=$\rho(V_g - V_p)D_p/\mu$
Pr=Prantl Number=$\mu C_p/k$
ρ=gas density
$V_g$=gas velocity
$V_p$=particle velocity
μ=absolute viscosity
Cp=specific heat
K=thermal conductivity The accelerating gas used in the embodiment of FIG. 1B may be introduced at inlet port 50 (FIG. 3A) from an accelerating gas source through high pressure tubing of stainless steel or copper (not shown). The accelerating gas travels from inlet port 50 to gas chamber 51 and then through accelerating gas connecting hole 53 into accelerating gas reservoir 54 which is sealed and surrounds powder feed tube 37. The hole to form accelerating gas connecting hole 53 is drilled from the exterior of the torch and plugged from the exterior of the torch 10 by plug 57. Accelerating gas ports 52 in convergence assembly 20 carry the accelerating gas from accelerating gas reservoir 54 to powder feed injection port 39. Accelerating gas ports 52 can vary in number and diameter. These ports 52 are preferably equally spaced around the central powder feed injection port 39 in convergence assembly 20. A preferred number of accelerating gas ports 52 is three (FIG. 7A).

The accelerating gas from ports 52 thereby is injected into the powder feed stream in powder feed injection port 39 in convergence assembly 20 which is joined in the nozzle entrance 44 by the converging combustion streams in 38 and 40. The accelerating gas joining the combustion flow increases the mass and force of the combustion stream as it accelerates through the convergent/divergent nozzle 22, allowing the flame to reach its necessary force and temperature in a shorter distance from the nozzle outlet 45 than would otherwise be possible. Hence the closer spray distance is obtained through the use of accelerating gas combined with a small physical size of the torch, increased injection pressure and increased power relative to torch size through increased power via increased fuel through the primary fuel supply and/or accelerating gas ports exiting inside the nozzle. This is partially facilitated by optimizing heat transfer resulting in improved torch cooling.

If supercritical $CO_2$ is to be used as accelerating gas, accelerating gas orifices must be such that for a given flow rate, the upstream pressure must be above the critical point of 72.9 atm (7.39 MPa, 1,071 psi) and the accelerant temperature must be above 31.1 degrees C. For example, for a flow of 0.1 liter per minute $CO_2$ with a density of 927 kg/m$^3$, a total orifice area of 0.125 mm$^2$ would necessitate a back pressure of 80.5 atm which would meet the supercritical pressure requirement. For 3 ports 52 this would equate to a hole diameter of 125 microns and for 5 ports 52 this would equate to 97 microns.

Particle acceleration in a gas flow is given by the equation:

$$\frac{dv_p}{dt} = \frac{1}{2m_p} C_D \rho_g A_P (v_g - v_p)|v_g - v_p|$$

$C_D$=Particle Drag Coefficient
$\rho_g$=Gas Density
$A_p$=Area Particle
$v_g$=velocity gas
$v_p$=velocity particle Particle acceleration can therefore be increased by increasing the gas density. The density of the gas can be determined using PV=nRT. Substituting $n=m/M_w$.

$$\text{Density } \rho = m/V = M_w P/RT.$$

Therefore, density can be increased by increasing the gas molecular weight and pressure.

Carbon dioxide may be used as a coolant and accelerating gas. Carbon dioxide has a density that is 2.4 times greater than steam ($H_2O$) generated from hydrogen fueled torches. At temperature and pressures above 31.10° C., 72.9 atm respectively carbon dioxide is supercritical. Supercritical $CO_2$ has a density 467 kg/m$^3$ at its critical point. This compares to a density of 1.98 kg/m$^3$ at standard temperature and pressure. Using liquid carbon dioxide that is widely available, and is denser than other alternative accelerant gases at the operating temperatures is therefore preferred. Once the accelerant gas is injected, the super critical fluid pressure will decrease and the fluid will transform into a gas and rapidly expand, thereby adding to the acceleration.

The use of carbon dioxide also has the added benefit of reducing the tendency of tungsten carbide (WC) to oxidize to $W_2C$ through the following equation.

$$2WC + O_2 = W_2C + CO_2$$

By increasing the partial pressure of $CO_2$ in the system, this reaction is suppressed.

Typical initial conditions for an operating torch are as follows:

a) Hydrogen 400 slpm, Oxygen 200 slpm (72 kW)
b) Powder WC-CoCr, D50=10 μm, ρ=13.5 g/cm3
c) Initial liquid $CO_2$ at −20 C and 100-200 bar If fuel is used as an accelerating gas, the amount of fuel accelerating gas can be greater, less than or equal to the primary fuel gas flow and does not need to be the same as the primary gas type. The oxidizer will be adjusted accordingly.

Typical operating parameters at 79 kW are as follows:

a) $H_2$: 440 lpm
b) $O_2$: 220 lpm
c) Carrier (Ar): 20 lpm
d) Water flow: 36 lpm
e) $H_2O$ in: 14° C.
f) $H_2O$ out: 27° C.
g) Powder feeder pressure: 65 psi
h) Heat of Combustion: 79 kW A gaseous fuel such as: hydrogen, methane, ethylene, ethane, propane, propylene, or liquid fuel such as kerosene or diesel can be added through the accelerating gas inlet ports 50, 52 into the convergence to increase gas temperature and velocity. Increased temperature and pressure with transfer to the particles increase these particles temperature and velocity. With fuel accelerant being used, excess oxygen in the primary flow is used to combust the fuel in the nozzle region. The amount of accelerant fuel can be used to control the temperature and velocity of the flame and particle velocity.

While a number of exemplary aspects and embodiments have been discussed above, those of skill in the art will recognize certain modifications, permutations, additions and sub-combinations thereof. Although the operation parameters described above are typical, it is anticipated that the torch is capable of higher fuel and oxygen flow that will further allow increased temperature and velocity of gas streams and powder. It is therefore intended that the invention be interpreted to include all such modifications, permutations, additions and sub-combinations as are consistent with the broadest interpretation of the specification as a whole.

What is claimed is:

1. A high velocity oxygen fuel (HVOF) or high velocity air fuel (HVAF) thermal spray apparatus to apply coatings to external and internal surfaces of a target, said HVOF or HVAF thermal spray apparatus comprising:

a combustion chamber having a primary passage for combustion of fuel received through a fuel input line with oxygen or air received through an oxidizing gas input line;

a divergence section downstream of said combustion chamber, the divergence section having two or more channels diverging relative a longitudinal axis of the primary passage of the combustion chamber;

an elbow housing downstream of said divergence section;

a nozzle housing downstream of said elbow housing, the nozzle housing retaining a nozzle having an injection zone and a nozzle throat;

a convergence section retained between said elbow housing and said nozzle housing, the convergence section having two or more channels converging toward the injection zone of said nozzle;

a feedstock injector for the injection of feedstock material for forming said coatings into the injection zone of said nozzle; and a plurality of passageways extending through said combustion chamber, said divergence section, said elbow housing, and said convergence section for passing a coolant therethrough.

2. The HVOF or HVAF thermal spray apparatus of claim 1, wherein the plurality of passageways comprise a plurality of slots formed around the circumferential edge of the convergence section and extending along an axial axis of the convergence section.

3. The HVOF or HVAF thermal spray apparatus of claim 2, wherein the plurality of passageways comprise a plurality of grooves interspaced between a plurality of fins formed on a top surface of the convergence section for facilitating flow of the coolant through the plurality of grooves.

4. The HVOF or HVAF thermal spray apparatus of claim 3, wherein at least some of the plurality of grooves are in fluid communication with at least some of the plurality of slots to facilitate flow of the coolant through the convergence section.

5. The HVOF or HVAF thermal spray apparatus of claim 3, wherein the plurality of passageways further comprise one or more transverse passages extending in directions transverse to the axial axis of the convergence section.

6. The HVOF or HVAF thermal spray apparatus of claim 5, wherein the transverse passages are located on the top surface of the convergence section for influencing flow of the coolant.

7. The HVOF or HVAF thermal spray apparatus of claim 6, wherein the transverse passages are formed between the elbow housing and the top surface of the convergence section to facilitate cooling of both the elbow housing and the convergence section.

8. The HVOF or HVAF thermal spray apparatus of claim 6, wherein the transverse passages are enclosed through the coupling between the elbow housing and the top surface of the convergence section to cause the coolant to flow through an enclosed path located between the elbow housing and the convergence section.

9. The HVOF or HVAF thermal spray apparatus of claim 5, wherein the two or more converging channels extend through an obround protrusion of the convergence section.

10. The HVOF or HVAF thermal spray apparatus of claim 9, wherein the transverse passages are arranged to form an obround shape around the obround protrusion.

11. The HVOF or HVAF thermal spray apparatus of claim 1, wherein the plurality of passageways comprise a plurality of longitudinal passages extending in a direction parallel to the longitudinal axis of the primary passage through the combustion chamber.

12. The HVOF or HVAF thermal spray apparatus of claim 11, wherein the plurality of longitudinal passages are circumferentially spaced around the primary passage.

13. The HVOF or HVAF thermal spray apparatus of claim 1, wherein the coolant is water.

* * * * *